US009259639B2

(12) United States Patent
Davis

(10) Patent No.: US 9,259,639 B2
(45) Date of Patent: Feb. 16, 2016

(54) SELF-LEVELING PLATFORM SYSTEM, SELF-LEVELING SUPPORTS, AND METHOD OF ASSEMBLING A SELF-LEVELING PLATFORM SYSTEM

(75) Inventor: Adam Davis, Leola, PA (US)

(73) Assignee: Tait Towers Manufacturing, LLC

( * ) Notice: Subject to any disclaimer, the term of this patent is extended or adjusted under 35 U.S.C. 154(b) by 211 days.

(21) Appl. No.: 13/486,386

(22) Filed: Jun. 1, 2012

(65) Prior Publication Data

US 2013/0319796 A1 Dec. 5, 2013

(51) Int. Cl.

| | |
|---|---|
| ***E04G 1/15*** | (2006.01) |
| ***E04G 5/02*** | (2006.01) |
| ***A63C 19/02*** | (2006.01) |
| ***E04G 1/24*** | (2006.01) |
| ***E04G 7/30*** | (2006.01) |
| ***E04H 3/28*** | (2006.01) |
| *A63C 19/00* | (2006.01) |

(52) U.S. Cl.

CPC . *A63C 19/02* (2013.01); *E04G 1/15* (2013.01); *E04G 1/24* (2013.01); *E04G 5/02* (2013.01); *E04G 7/301* (2013.01); *E04H 3/28* (2013.01); *A63C 19/005* (2013.01); *A63C 2203/10* (2013.01); *Y10T 29/49826* (2015.01)

(58) Field of Classification Search

CPC ..... E04G 1/15; E04G 5/02; E04G 5/025; E04G 1/00; E04G 7/30

USPC ..... 182/222, 223, 186.6, 152, 178.1; 108/144.11, 146, 147, 147.19–148; 52/126.5, 126.6, 7

See application file for complete search history.

(56) References Cited

U.S. PATENT DOCUMENTS

| | | | | |
|---|---|---|---|---|
| 2,621,879 | A | | 12/1952 | Lundeen |
| 2,673,700 | A | | 3/1954 | Eberhardt |
| 2,700,520 | A | | 1/1955 | Skubic |
| 2,844,344 | A | | 7/1958 | Streb et al. |
| 2,863,568 | A | | 12/1958 | Skubic |
| 3,730,109 | A | | 5/1973 | Kreizel et al. |
| 4,083,530 | A | * | 4/1978 | Linnepe ..... 254/95 |
| 4,638,604 | A | | 1/1987 | Rogers et al. |
| 4,843,792 | A | * | 7/1989 | Rogers et al. ..... 52/127.7 |

(Continued)

FOREIGN PATENT DOCUMENTS

| | | | |
|---|---|---|---|
| CA | 1257064 | A | 7/1989 |
| CA | 1278164 | C | 12/1990 |

(Continued)

*Primary Examiner* — Katherine Mitchell
*Assistant Examiner* — Shiref Mekhaeil
(74) *Attorney, Agent, or Firm* — McNees Wallace & Nurick LLC

(57) ABSTRACT

A platform system for self-leveling a stage is provided and includes one or more module assemblies and one or more supports. Each module assembly includes one or more receiving members for engaging and removably securing the one or more supports. Each support includes an elongate portion, an extendible portion extendible from and lockingly engageable with the elongate portion, a base member removably attached to the extendible portion, and an actuator assembly secured to the elongate portion and in communication with the extendible portion. The actuator assembly is configured to rapidly extend and lockingly engage the extendible portion and the base member to provide self-leveling of each of the one or more module assemblies of the stage as the base member engages an underlying surface.

21 Claims, 27 Drawing Sheets

(56) References Cited

U.S. PATENT DOCUMENTS

| | | | | |
|---|---|---|---|---|
| 4,845,915 | A * | 7/1989 | Rogers et al. | 52/782.1 |
| 5,037,232 | A | 8/1991 | Pakdipanichpong | |
| 5,186,429 | A * | 2/1993 | Linnepe et al. | 248/354.1 |
| 5,323,563 | A * | 6/1994 | Rogers et al. | 52/7 |
| 5,649,558 | A * | 7/1997 | Richard | 135/67 |
| 6,145,524 | A * | 11/2000 | Li et al. | 135/67 |
| 7,470,081 | B2 | 12/2008 | Miyahara et al. | |
| 7,703,401 | B2 * | 4/2010 | Davis et al. | 108/156 |
| 7,922,416 | B2 * | 4/2011 | Davis et al. | 403/322.1 |
| 8,136,460 | B2 * | 3/2012 | Tait et al. | 108/157.1 |
| 2007/0266908 | A1 | 11/2007 | Monteith et al. | |
| 2009/0301359 | A1 | 12/2009 | Tait et al. | |
| 2012/0152157 | A1 * | 6/2012 | Tait et al. | 108/157.1 |
| 2012/0222588 | A1 * | 9/2012 | Davis et al. | 108/64 |
| 2012/0240406 | A1 * | 9/2012 | Davis et al. | 29/897 |
| 2012/0240510 | A1 * | 9/2012 | Tait et al. | 52/741.1 |
| 2013/0235282 | A1 * | 9/2013 | Davis et al. | 348/839 |
| 2013/0337925 | A1 * | 12/2013 | Hsu et al. | 472/125 |
| 2014/0026514 | A1 * | 1/2014 | Davis et al. | 52/645 |

FOREIGN PATENT DOCUMENTS

| | | | |
|---|---|---|---|
| EP | 0160843 | A2 | 11/1985 |
| ES | 8605313 | A1 | 8/1986 |
| JP | 60238577 | A | 11/1985 |
| JP | 6037812 | B | 5/1994 |
| JP | 1925633 | C | 4/1995 |

* cited by examiner

SELF-LEVELING PLATFORM SYSTEM, SELF-LEVELING SUPPORTS, AND METHOD OF ASSEMBLING A SELF-LEVELING PLATFORM SYSTEM

FIELD OF THE INVENTION

The present invention is directed to platform systems and methods of assembling platform systems. In particular, the present disclosure is directed to self-leveling platform systems with self-leveling supports and methods of assembling platform systems with self-leveling supports.

BACKGROUND OF THE INVENTION

Stages and platforms can require use of tools, such as wrenches or screwdrivers, and/or hammers for assembly and/or disassembly. Locking mechanisms for supports have been used; however, they are difficult to assemble and disassemble, subject to misalignment, require a plurality of pieces, require tools for certain adjustments, do not offer adequate stability, do not have easily replaceable parts, and do not work well in conjunction with other parts of the stage or platform structures. Further, known stages and platforms require the design and insertion of various shims under the support legs to account for uneven surfaces, and do not self-level quickly during assembly.

What is needed is a self-leveling platform system, self-leveling support, and a method of assembling a self-leveling platform system that do not suffer from one or more of the above drawbacks in the art.

BRIEF DESCRIPTION OF THE INVENTION

According to an embodiment, a platform system for self-leveling a stage includes one or more module assemblies, each module assembly includes one or more receiving members; and one or more supports engaged and removably secured to each of the one or more receiving members. Each support includes an elongate portion, an extendible portion extendible, a base member, and an actuator assembly. The extendible portion is extendible from and lockingly engageable with the elongate portion. The base member is removably attached to the extendible portion. The actuator assembly is secured to the elongate portion and in communication with the extendible portion. The actuator assembly is configured to rapidly extend and lockingly engage the extendible portion and the base member to provide self-leveling of each of the one or more module assemblies of the stage as the base member engages an underlying surface.

According to an embodiment, a support for a platform system is provided. The support includes an elongate portion, an extendible portion, a base member, and an actuator assembly. The elongate portion includes a first end having a tapered portion, and a second end. The extendible portion is operable to extend from and lockingly engage the second end of the elongate portion. The base member is removably attached to the extendible portion. The actuator assembly is secured to the elongate portion and in communication with the extendible portion. The support engages and removably secures to one or more receiving members of a module assembly. The actuator assembly is configured to rapidly extend and lockingly engage the extendible portion and the base member to provide self-leveling of one or more module assemblies of the platform system as the base member engages an underlying surface.

According to an embodiment, a method of assembling a platform system is provided. The method includes providing one or more module assemblies including one or more receiving members, and providing one or more supports. The supports include an elongate portion, an extendible portion, a base member, and an actuator assembly. The elongate portion includes a first end and a second end, an extendible portion operable to extend from and lockingly engage the second end of the elongate portion. The base member is removably attached to the extendible portion. The actuator assembly is secured to the elongate portion and in communication with the extendible portion. The method includes securing the one or more supports to the one or more receiving members and actuating the actuator assembly. Actuating the actuator assembly extends the extendible portion until the base member engages an underlying surface. The base member provides self-leveling of each of the one or more module assemblies secured to the one or more supports. The method includes locking the extendible portion to secure the one or more supports in an extended and leveled position.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided is a self-leveling platform system, a self-leveling support, and a method of assembling a self-leveling platform system. Embodiments of the present disclosure permit ease of assembly and disassembly, reduce or eliminate assembly errors, increase stability of (for example, by reducing swaying, bending, and other lateral forces), permit individuals with little or no technical skill to assemble and/or disassemble platform systems, permit assembly and/or disassembly by hand, permit self-leveling of supports and platform systems or combinations thereof.

Figure 1B:
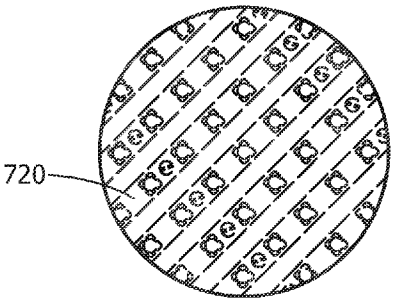
FIG. 1B shows an enlarged view of a portion of FIG. 1A.
Figure 1A:
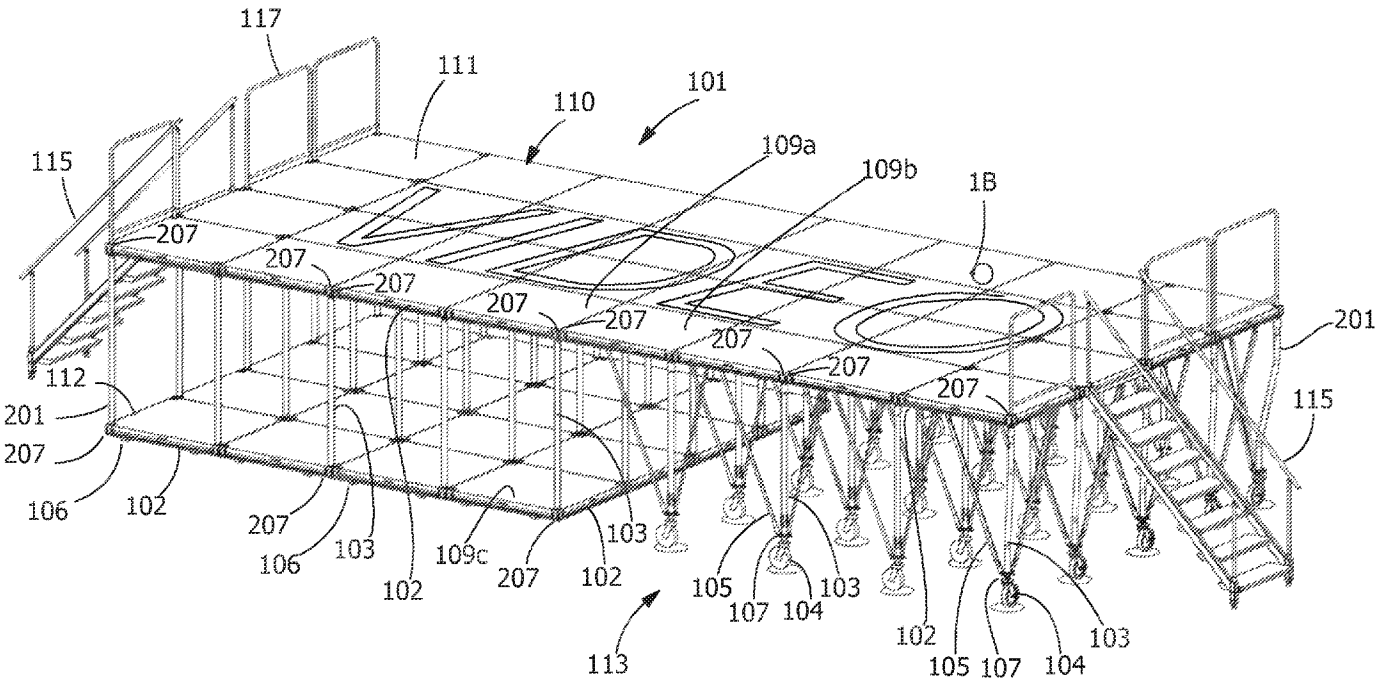
FIG. 1A shows a top perspective view of a platform system according to the disclosure.

FIG. 1A shows an embodiment of a platform system 101 including a module assembly 102. The module assembly 102 shown includes a receiving member 207 and a plurality of video modules 109 (enlarged in FIG. 1B). In one embodiment, the receiving member 207 engages one or more supports 103 (see also FIGS. 2 and 34). The supports 103 are elongate structures having a laterally stabilizing support structure 107 and an elongate portion 201 (for example, a cylindrical tube) (see also FIGS. 31 and 34).

In one embodiment, the platform system 101 is configured as a stage or platform for any suitable event, such as an entertainment or sporting event. Examples of events include, but are not limited to, concerts, dance exhibits, wrestling matches, or other performances, other examples of uses for the platform system 101 include, but are not limited to, media/announcer areas, concessions, ticket or merchandizing areas, or equipment supports. The platform system 101 is located in any suitable environment, such as, but not limited to, outdoors, exposed to ambient conditions, indoors, underwater, partially exposed, and combinations thereof. The platform system 101 is supported from underneath by any suitable underlying surface 414 (see FIGS. 34 and 35), such as, but not limited, to a hardwood floor, a carpeted floor, a concrete slab, a brick lot, a street, a sloped floor, an uneven floor, a dirt field, a grassy meadow, a flooded yard, and combinations thereof. In one embodiment, the platform system 101 is capable of being quickly and easily leveled when assembled on uneven or sloped surfaces or terrain, such as at outdoor venues.

Figure 34:
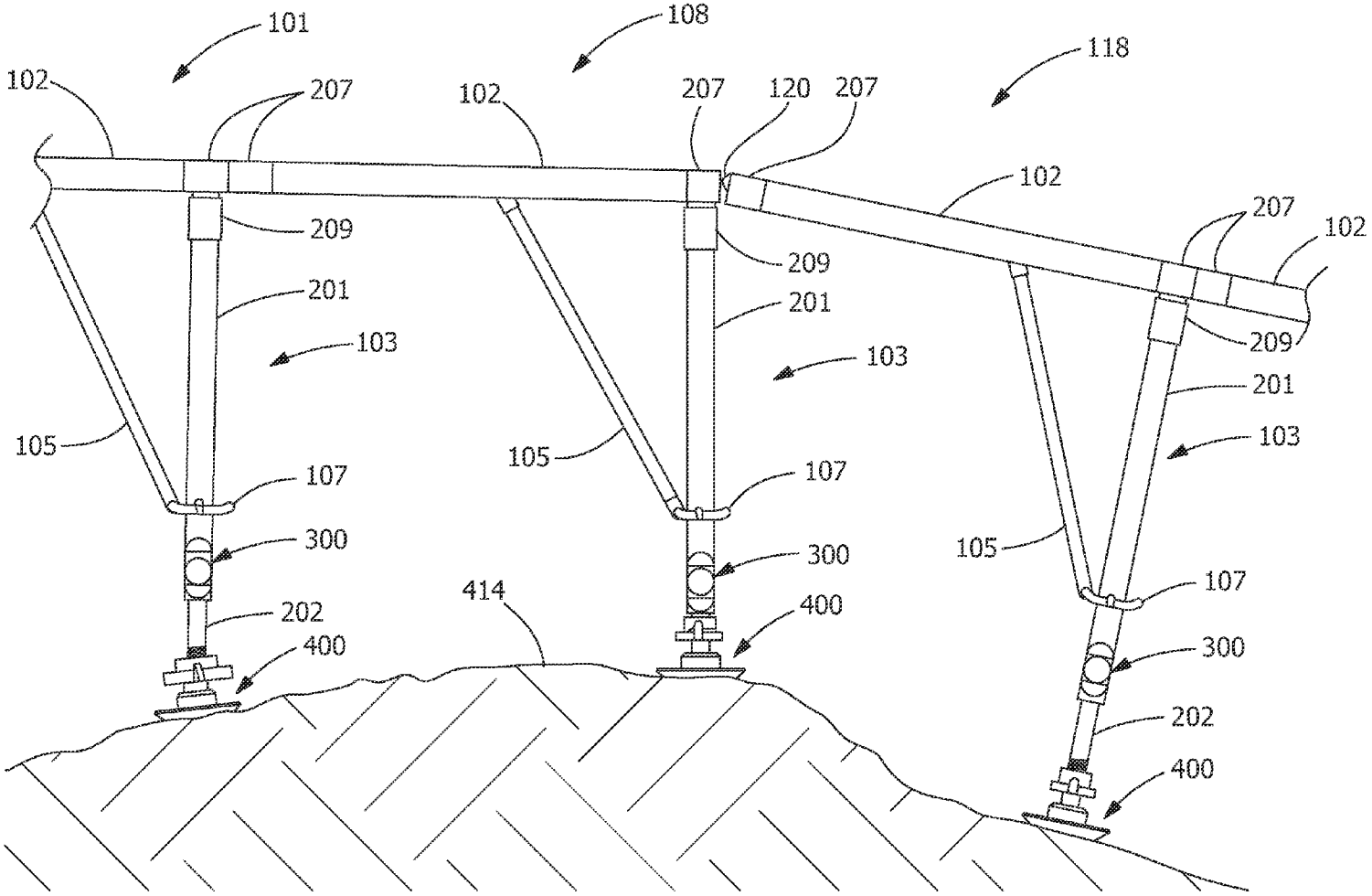
FIG. 34 shows a partial side view of a platform system according to the disclosure.
Figure 35:
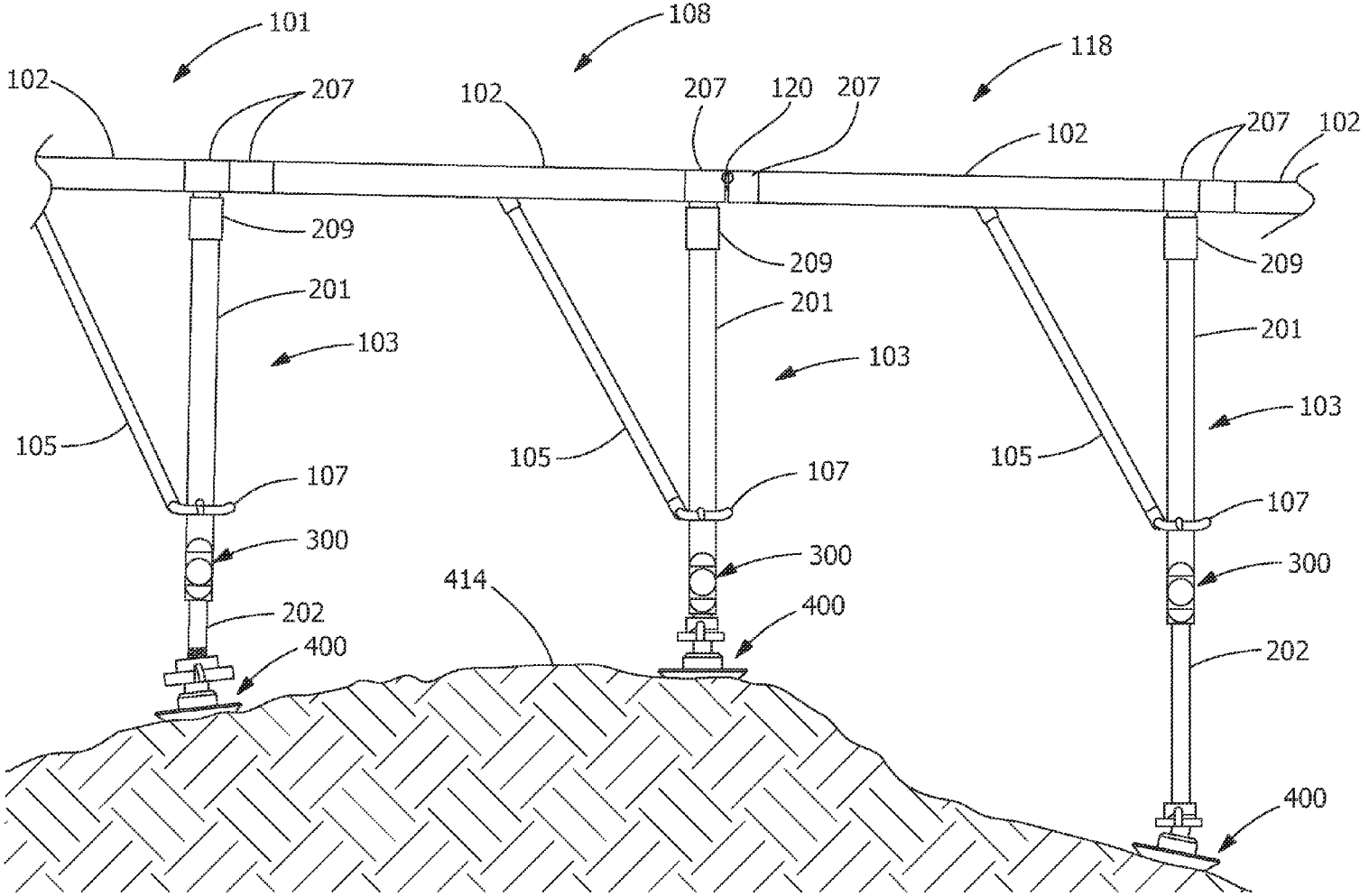
FIG. 35 shows a partial side view of a platform system according to the disclosure.

Referring to FIGS. 34 and 35, in one embodiment, the platform system 101 for leveling a stage includes one or more module assemblies 102 and one or more supports 103. Each module assembly 102 includes one or more receiving members 207. The one or more supports 103 are engaged and removably secured to each of the one or more receiving members 207. Each support 103 includes an elongate portion 201, an extendible portion 202 extendible from and lockingly engageable with the elongate portion 201, a base member 400 removably attached to the extendible portion 202, and an actuator assembly 300 secured to the elongate portion 201 and in communication with the extendible portion 202. The actuator assembly 300 is configured to rapidly extend and lockingly engage the extendible portion 201 and the base member 400 to provide self-leveling of each of the one or more module assemblies 102 of the stage as the base member 400 engages an underlying surface 414.

Referring again to FIGS. 34 and 35, the support 103 includes a laterally stabilizing support structure 107 capable of connecting to a laterally stabilizing support 105. In one embodiment, the platform system 101 includes one or more walkout ramps 118 similar to a runway or catwalk, configured so a performer can move closer to the audience. The one or more walkout ramps 118 is operative to connect to a main platform system 108. In one embodiment, the main platform system 108 includes four or more rows and four or more columns of adjacently connected module assemblies 102 (as per the platform system 101 in FIG. 1A, for example). In one embodiment, the width the one or more walkout ramps 118 is less than the width of the main platform system 108 at the side where the connection is made (not shown). In one embodiment, the walkout ramp 118 includes one or more series of rows of from one to four adjacent module assemblies 102 connected to the main platform system 108 (not shown). The number of adjacent module assemblies 102 in the walkout ramp 118 varies as is desired by the application. In one embodiment, the module assembly 102 includes an adaptor connector system 120 that enables adjacent module assemblies 102 to be connected together at an angle relative to their horizontal planes (see FIG. 34).

The one or more module assemblies 102 of platform system 101 are self-leveled against an uneven underlying surface 414 by varying the length of the supports 103. In one embodiment, varying the length of the supports 103 positions the module assemblies 102 at a predetermined approximately level horizontal elevation (see FIG. 35). In one embodiment, varying the length of the supports 103 positions the module assemblies 102 of the main platform system 108 at a predetermined approximately level horizontal elevation, and positions the walkout ramp 118 at a predetermined slope relative to the main platform system 108 (see FIG. 34).

Figure 31:
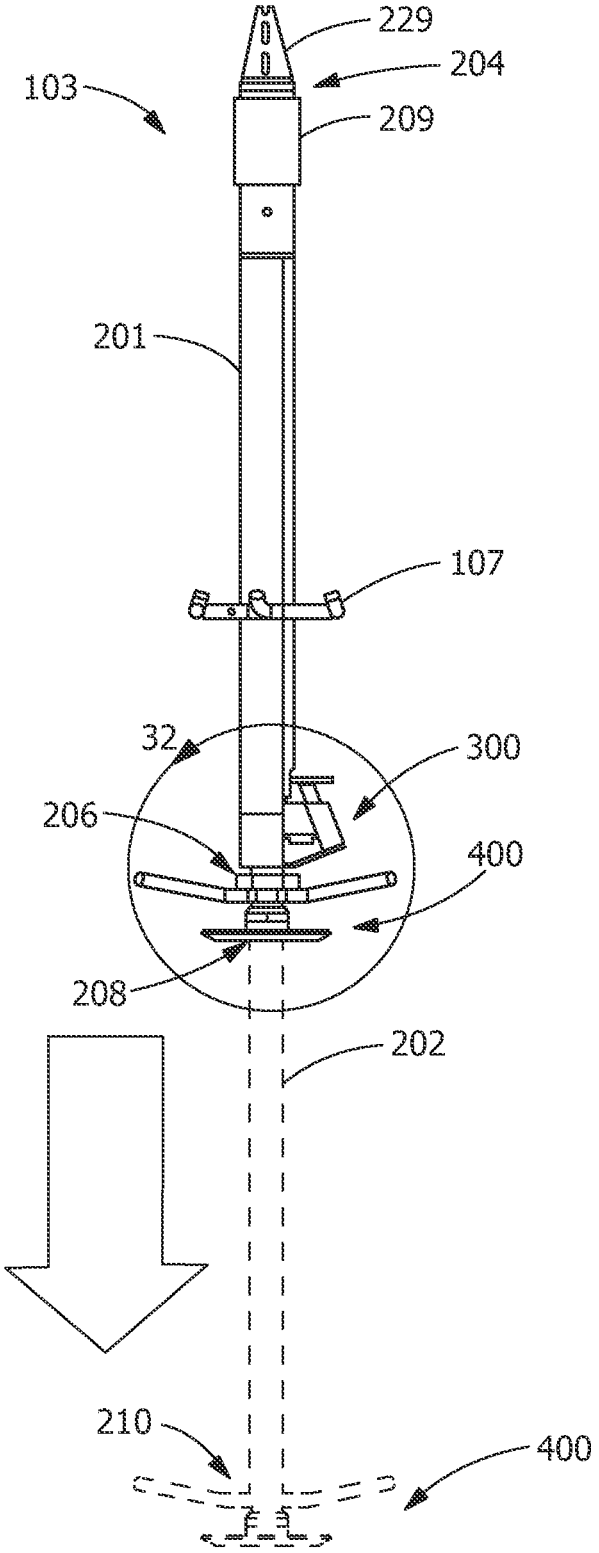
FIG. 31 shows a side view of a support according to the disclosure.
Figures 32, 32A:
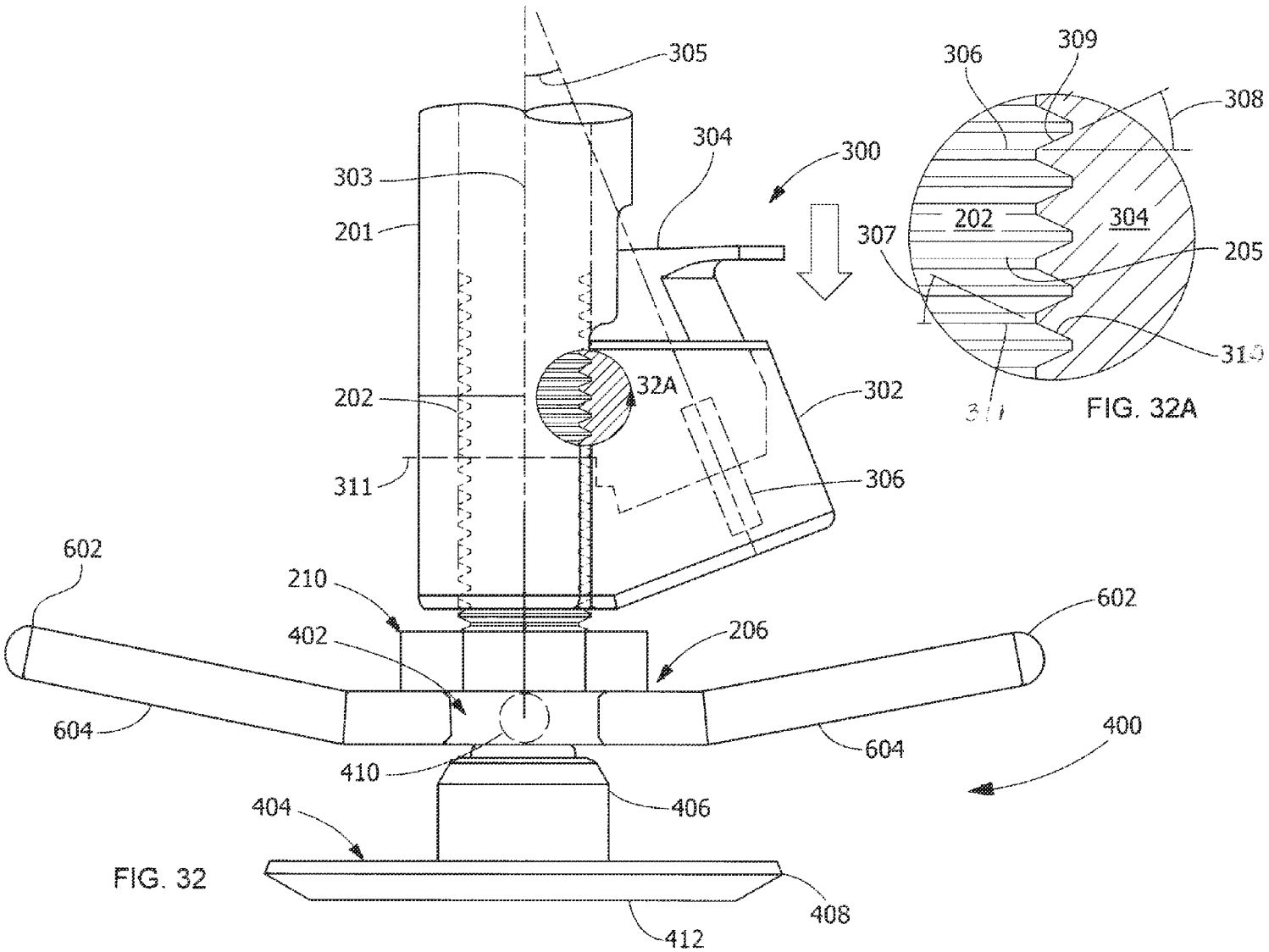
FIG. 32 shows an enlarged view of a second end portion of FIG. 31 according to the disclosure.
FIG. 32A shows an enlarged cutaway view of a portion of FIG. 32 according to the disclosure.
Figure 33:
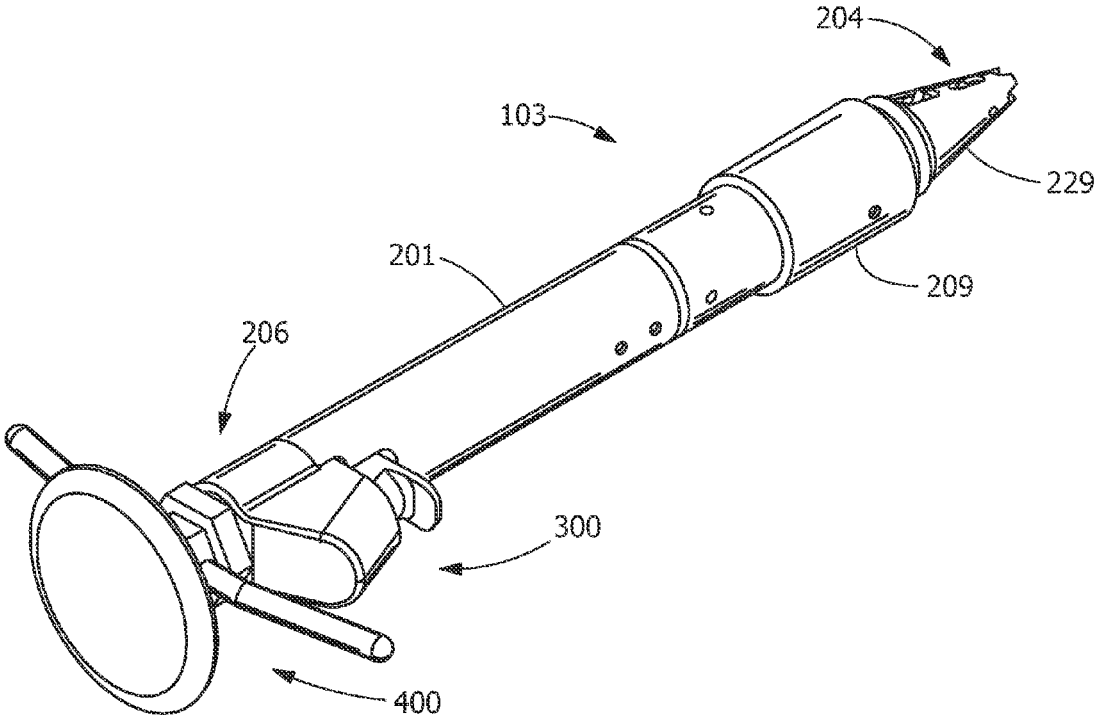
FIG. 33 shows a perspective view of a support according to the disclosure.

Referring to FIGS. 31-33, the elongate portion 201 includes a first end 204 having a tapered portion 229, and a second end 206. The extendible portion 202 is operable to extend from and lockingly engage the second end 206 of the elongate portion 201. In one embodiment, the extendible portion 202 is configured to be telescoping, or to slide within the elongate portion 201. The extendible portion 202 includes a first end 208 and a second end 210. The first end 208 of the extendible portion 202 includes any suitable stop feature, such as a perimeter flange (not shown), for example, to prevent the extendible portion 202 from becoming totally disconnected from the elongate portion 201 during extension of the extendible portion 202.

As shown best in FIG. 32, the actuator assembly 300 is secured to the elongate portion 201 and in communication with the extendible portion 202. The actuator assembly 300 is configured to rapidly extend and lockingly engage the extendible portion 202 and the base member 400 to provide self-leveling of each of the one or more module assemblies 102 of the platform system 101 as the base member 400 engages an underlying surface 414.

Referring to FIG. 32, the actuator assembly 300 includes a housing 302, an actuator 304, and a biasing device 306 arranged and disposed within the housing 302. The biasing device 306 is in communication with the actuator 304. In one embodiment, the actuator 304 is configured such that at least a portion of the actuator 304 is slideable down within the housing 302 upon activation by the application of force. A suitable example of activation by force includes, but is not limited to, a push button. In one embodiment, the actuator 304 is configured to slide along an axis that forms an angle 305 with a longitudinal axis 303 of the extendible portion 202. The angle 305 is from about 14 degrees to about 34 degrees, or alternatively from about 17 degrees to about 31 degrees, or alternatively from about 20 degrees to about 28 degrees. In one embodiment, the biasing device 306 is any suitable biasing device, such as, but not limited to, a spring, configured to bias the actuator 304 into a locked position. The locked position is a position operating to lockingly secure the extendible portion 202 of the support 103 and prevent movement of the extendible portion 202 within the elongate portion 201 of the support 103. In the locked position, the extendible portion 202 does not move within the elongate portion 201. The locked position prevents the extendible portion 202 from extending from or retracting within the elongate portion 201.

As shown in FIGS. 32 and 32A, the actuator 304 includes a retention system 308 configured to engage and lockingly secure the extendible portion 202. The retention system 308 is any suitable system configured to lockingly engage the extendible portion 202 in a locked position, and disengage the extendible portion 202 upon activation of the actuator 304. In one embodiment, activation of the actuator 304 is by a pressure or force applied, pushing downward on the upper surface of the actuator 304, causing it to slide down into the housing 302. The actuator 304 is generally configured to be operated by any suitable force transferring device, such as, but not limited to a user's hand, foot, or by a tool, or other suitable device. One example of applying pressure or force, includes, but is not limited to, an operator stepping down on the upper surface of the actuator 304.

As shown in FIGS. 32 and 32A, the retention system 308 includes any suitable arrangement of one or more protrusions, recesses, and combinations thereof, configured for engaging with the extendible portion 202. In one embodiment, one or more of the one or more protrusions, recesses, and combinations thereof, include an angled surface 309. The angled surface 309 of the one or more protrusions, recesses, and combinations thereof, forms an angle 307 with a traverse plane 311 of the extendible portion 202, and the angle 307 of the one or more protrusions, recesses, and combinations thereof, is approximately equal to the angle 305 of the actuator. In one embodiment, the one or more protrusions, recesses, and combinations thereof have a suitable curved geometry, such as, but not limited to, concave geometry, relative to the longitudinal axis 303 of the extendible portion 202. In one embodiment, the concave geometry of the protrusions, recesses, and combinations thereof, is approximately equal to, or matches the perimeter curvature of the extendible portion 202 relative to the longitudinal axis 303 of the extendible portion 202.

Referring again to FIGS. 32 and 32A, in one embodiment, the extendible portion 202 includes a reception system 205 operable to engage the actuator 304. The reception system 205 includes any suitable arrangement of longitudinally spaced openings, recesses, protrusions, and combinations thereof, on an exterior surface of the extendible portion 202, such as, but not limited to, a straight threaded surface. The reception system 205 is configured to cooperate with and engage the retention system 308 of the actuator 304, thereby locking the extendible portion 202 of the support 103 in the locked position. In one embodiment, one or more of the spaced openings, recesses, protrusions, and combinations thereof, include an angled surface 310. The angled surface 310 of the one or more of the spaced openings, recesses, protrusions, and combinations thereof, also forms the angle 307 with the traverse plane 311 of the extendible portion 202. In one embodiment, the one or more protrusions, recesses, and combinations thereof of reception system 205 and the one or more protrusions, recesses, and combinations thereof of the retention system 308 are configured with suitable cooperating and mating geometries, such as, but not limited to gear teeth, so as to mesh during engagement. In one embodiment, during engagement, the angled surfaces 309 of the retention system 308 engage at least a portion of the angled surfaces 310 of the reception system 205.

In one embodiment, activating the actuator 304 disengages the retention system 308 from the reception system 205 (see FIG. 31). Activating the actuator 304 operates to slide and move the actuator 304 inside the housing 302 at angle 305, thereby disengaging the one or more of the spaced openings, recesses, protrusions, and combinations thereof, of the of reception system 205 and the one or more protrusions, recesses, and combinations thereof, of the retention system 308. Activating the actuator 304 by continued application of force or pressure continues to keep the retention system 308 disengaged from the extendible portion 202, thereby allowing the extendible portion 202 to slide freely within the elongate portion 201. Activating the actuator 304 and disengaging the retention system 308 releases the extendible portion 202, allowing gravity to extend the extendible portion 202 downward to engage the underlying surface 414. This automatic extension of the extendible portion 202 results in self-leveling of the one or more module assemblies 102. In an alternative embodiment, activating the actuator 304 releases the extendible portion 202, and the extendible portion 202 is manually extended or retracted into position. In one embodiment, releasing the pressure or force from the actuator 304 acts to re-engage the retention system 308 with the reception system 205 of the extendible portion 202, thereby locking the extendible portion 202 back into place into the locking position. The reception system 205 is configured to allow the extendible portion 202 to be positioned and locked to provide various lengths for the support 103 as required during assembly of the platform system 101. The variable lengths of the support 103 allow for self-leveling of the platform system 101 when the underlying surface 414 is uneven (see FIGS. 34 and 35). Once the platform system 101 is self-leveled, the actuators 304 maintain the supports 103 in a locked, self-leveled position. In one embodiment, the actuator assembly 300 includes a safety lock device (not shown) that operates to secure the actuator 304 in the locked position. The safety lock device operates to keep the extendible portion 202 in the locked, self-leveled position to guard against accidental activation of the actuator 304.

Referring to FIG. 32 again, the base member 400 is removably attached to the second end 210 of the extendible portion 202. In one embodiment, the base member 400 includes a center member 406 with a first end 402 and a foot 408 arranged and disposed at a second end 404. In one embodiment, the first end 402 includes any suitable pivot device or feature, such as, but not limited to, a ball joint 410. The pivot device or feature is operable to rotate the base member 400 relative to the longitudinal axis 303 of the extendible portion 202. In one embodiment, the second end 210 of the extendible portion 202 is configured to engage and cooperate with the ball joint 410 or other pivot feature.

In one embodiment, the foot 408 includes a substantially planar surface 412 for engaging an underlying surface 414 such as a floor or an outdoor field (see FIGS. 34 and 35). In one embodiment, the planar surface 412 includes gripping or projecting features (not shown) that operate to improve contact and engagement with the underlying surface 414, and to prevent sliding and/or slippage of the foot 408 once engaged (not shown). In one embodiment, as the planar surface 412 engages the underlying surface 414, the base member 400 rotates relative to the extendible portion 202, positioning the base member 400 substantially perpendicular to the underlying surface 414.

As shown in FIG. 32, the extendible portion 202 includes one or more handles 602 arranged and disposed at the second end 210, and extending therefrom. In one embodiment, two handles 602 extend each from opposing sides of the extendible portion 202, connecting substantially perpendicular to the vertical centerline of the extendible portion 202. In one embodiment, the handles 602 have angled portions 604 that extend upwards toward the first end 208 of the extendible portion 202. The handles 602 are configured to assist the user in retracting the extendible portion 202 back into the elongate portion 201. As shown in FIG. 32, the extendible portion 202 is capable of being retracted substantially fully back into the elongate portion 201, and lockingly engaged, to allow for a storage position, and ease of transport of the support 103.

Figure 37:
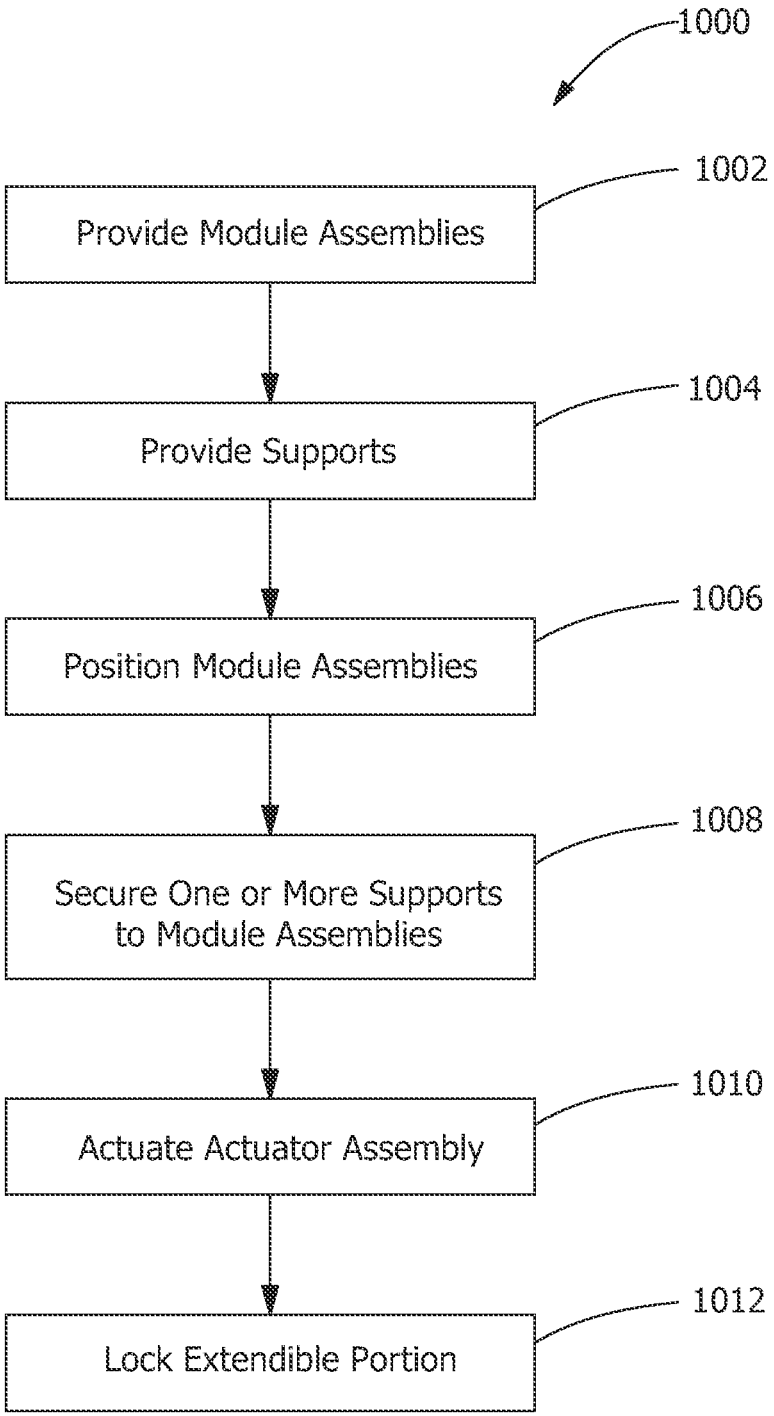
FIG. 37 is a flow chart of an exemplary method of assembling a platform system according to the disclosure.

As shown in FIG. 37, in one embodiment, a method 1000 of assembling a platform system 101 is provided. The method 1000 includes providing one or more module assemblies 102 including one or more receiving members 207 (step 1002, see FIG. 1A), and providing one or more supports 103 (step 1004, see FIGS. 34 and 35). As shown in FIG. 31, the supports 103 include an elongate portion 201 including a first end 204 and a second end 206, an extendible portion 202 operable to extend from and lockingly engage the second end 206 of the elongate portion 201, a base member 400 removably attached to the extendible portion 202, and an actuator assembly 300 secured to the elongate portion 201 and in communication with the extendible portion 202. The method 1000 includes positioning the module assembly 102 above or on the desired location on the underlying surface 414 (step 1006, see FIGS. 34 and 35). The method 1000 includes securing the one or more supports 103 to the one or more receiving members 207 (step 1008, see FIGS. 34 and 35). The method 1000 includes actuating the actuator assembly 300 (step 1010, see FIG. 31). Actuating the actuator assembly 300 extends the extendible portion 202 until the base member 400 engages an underlying surface 414 (see FIGS. 34 and 35). The base member 400 provides self-leveling of each of the one or more module assemblies 102 secured to the one or more supports 103. The method 1000 includes locking the extendible portion 202 to secure the one or more supports 103 in an extended and leveled position (step 1012, see FIGS. 34 and 35). In one embodiment, the method 1000 of assembling platform system 101 includes providing the main platform system 108 and one or more of the walkout ramps 118, and further connecting the one or more walkout ramps 118 to the main platform system 108. In one embodiment, the method 1000 further includes retracting the extendible portion 202 back into the elongate portion 201, and lockingly engaging the elongate portion 201 into a storage position for ease of disassembly and transport.

In an alternative embodiment, the method of assembling a platform system 101 (for example, see the platform system 101 of FIGS. 34 and 35) includes predetermining the approximate desired length of the one or more supports 103 to be used with a given module assembly 102. In one embodiment, the method of assembling a platform system 101 includes pre-extending the extendible portions 202 of the supports 103 until they reach the approximate desired length. The method includes securing the one or more supports 103 to the one or more receiving members 207, and positioning the module assembly 102 above or on the desired location on the underlying surface 414. In one embodiment, the alternative method of assembling platform system 101 includes providing the main platform system 108 and one or more of the walkout ramps 118, and further connecting the one or more walkout ramps 118 to the main platform system 108. The method includes actuating the actuator assembly 300 to level the module assembly 102 in a predetermined position relative to and against an uneven or sloped surface, thereby providing self-leveling of the module assembly 102. In one embodiment, the actuating the actuator assembly 300 extends or retracts the extendible portion 202 until the base member 400 engages a surface, providing self-leveling of each of the one or more module assemblies 102 secured to the one or more supports 103. The method includes locking the extendible portion 202 to secure the one or more supports 103 in an extended position, and in the locked and self-leveling position. In one embodiment, the actuator assembly 300 is re-actuated to either extend or retract the extendible portion 202 to account for variations in the load applied to the module assembly 102 or to account for settling or shifting of the underlying surface 414.

Figure 20:
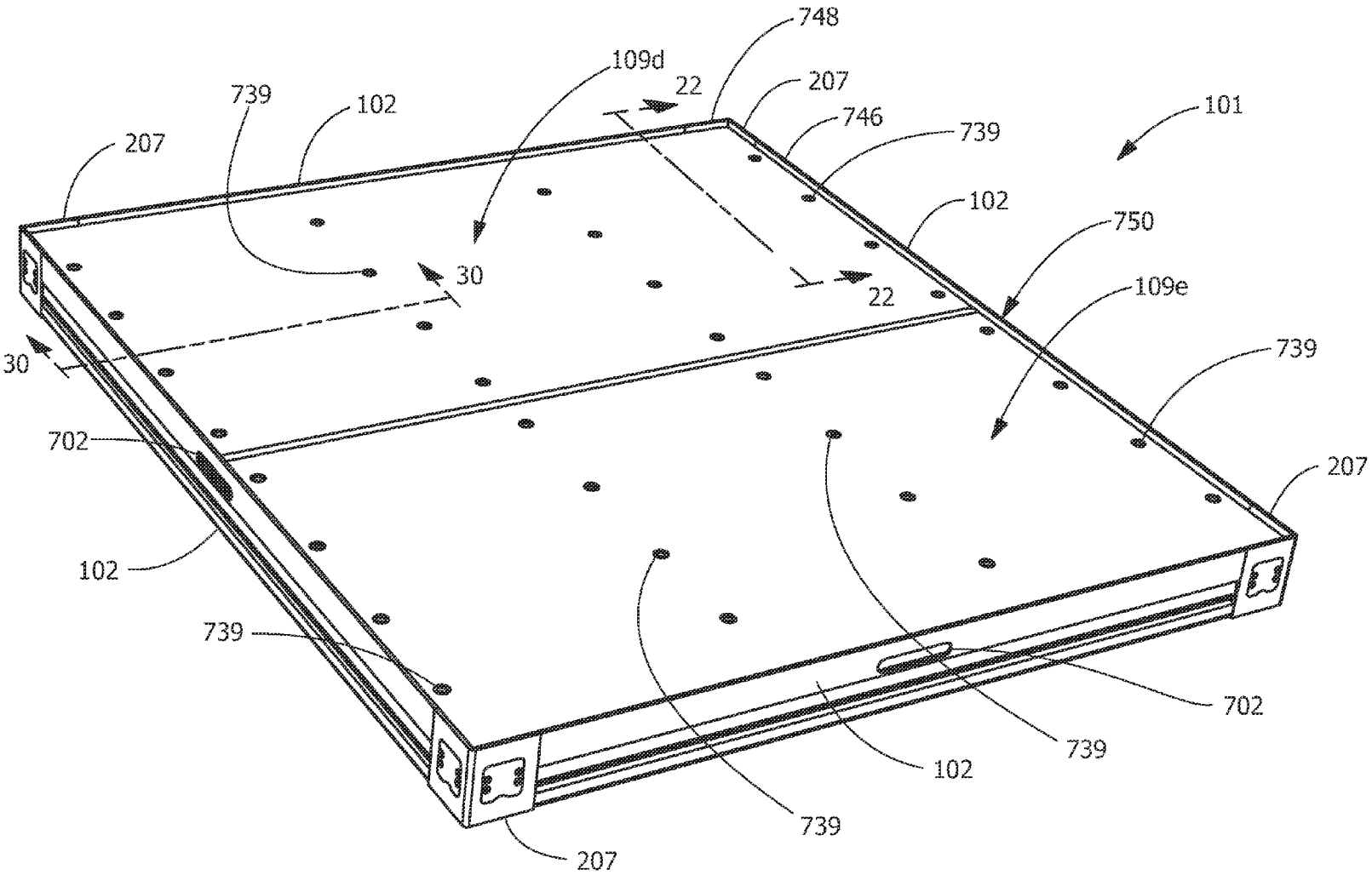
FIG. 20 shows a top perspective view of a module assembly according to the disclosure.

Referring to FIG. 20, in one embodiment, the platform system 101 includes the module assembly 102 with the video module 109 being removably secured to and supported by the receiving member 207. The module assembly 102 is configured to secure at least one video module 109. In one embodiment, the module assembly 102 is configured to secure the plurality of the video modules 109, for example, a fourth video module 109*d* and a fifth video module 109*e*. In further embodiments, the module assembly 102 is configured to secure three video modules 109, four video modules 109, or more. In one embodiment, the module assembly 102 is modular and is configured for use with any type of panel module capable of supporting a predetermined structural load. For example, in one embodiment, one or more of the plurality of the video modules 109 is temporarily or permanently replaced with a non-video module or a non-video module is otherwise included. Suitable non-video modules include, but are not limited to, mirrors, opaque modules, wood modules, grating, polymeric modules, trap door modules, elevator modules, pyrotechnic chambers, modules housing chambers (for example, with water, inside), or combinations thereof.

Figures 14A, 14B:
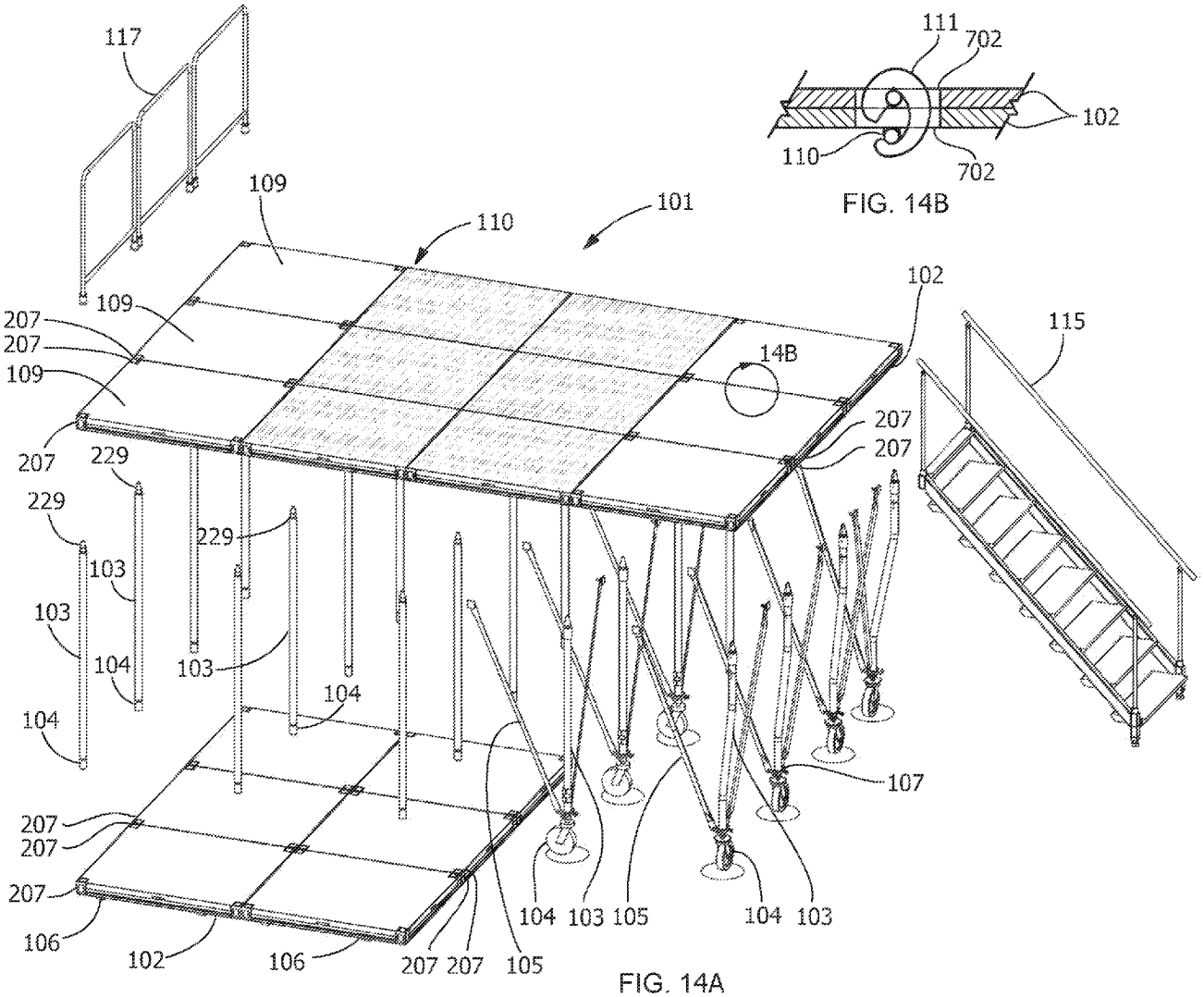
FIG. 14A shows an exploded view of a platform system according to the disclosure.
FIG. 14B shows an enlarged cutaway top view of adjacent module assembly connectors according to the disclosure.
Figure 24:
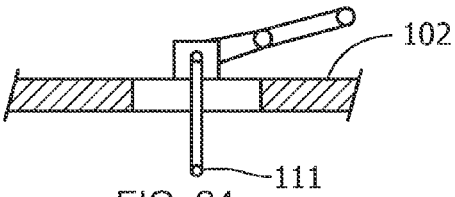
FIGS. 24 and 25 show partial top section views of a latch connector according to the disclosure.
Figure 25:
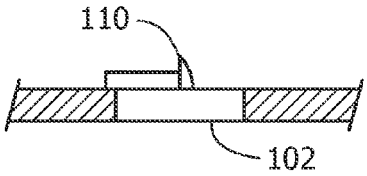
Figure 26:
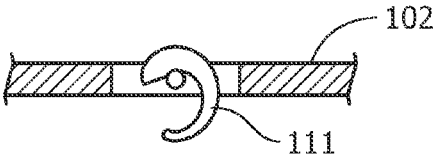
FIGS. 26 and 27 show partial top section views of a coffin lock connector according to the disclosure.
Figure 27:
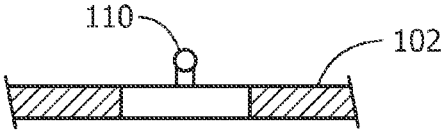
Figure 28:
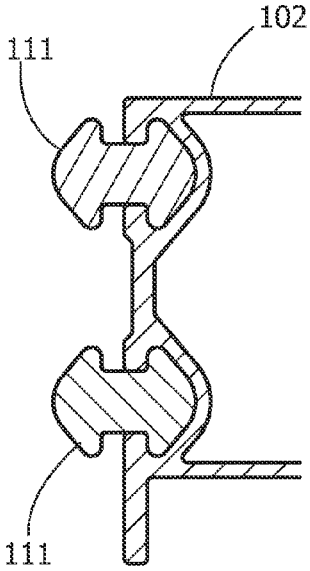
FIGS. 28 and 29 show partial side section views of a spline connector according to the disclosure.
Figure 29:
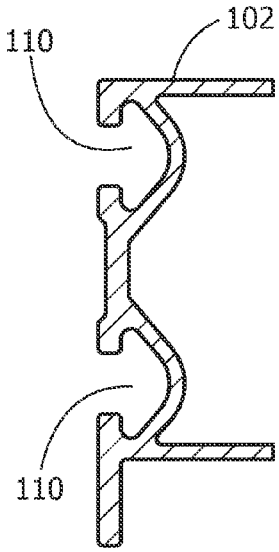

In one embodiment, the module assembly 102 includes a connector 702. The connector 702 secures the video modules 109 and/or the module assembly 102. The connector 702 provides support and stability, for example, by providing constant force, for example, by clamping, drawing, or otherwise providing force to urge the video modules 109 and/or the module assemblies 102 together. For example, as shown in FIG. 14B, in one embodiment, the connector 702 includes a rotatable latch member 111 and/or a receiving mechanism 112, thereby providing stable, locked engagement. In one embodiment, as shown in FIGS. 24 and 25, the connector 702 is or includes a latch connector. In one embodiment, as shown in FIGS. 26 and 27, the connector 702 is or includes a coffin lock connector. In one embodiment, as shown in FIGS. 28 and 29, the connector 702 is or includes a spline connector.

Figures 21A, 21B:
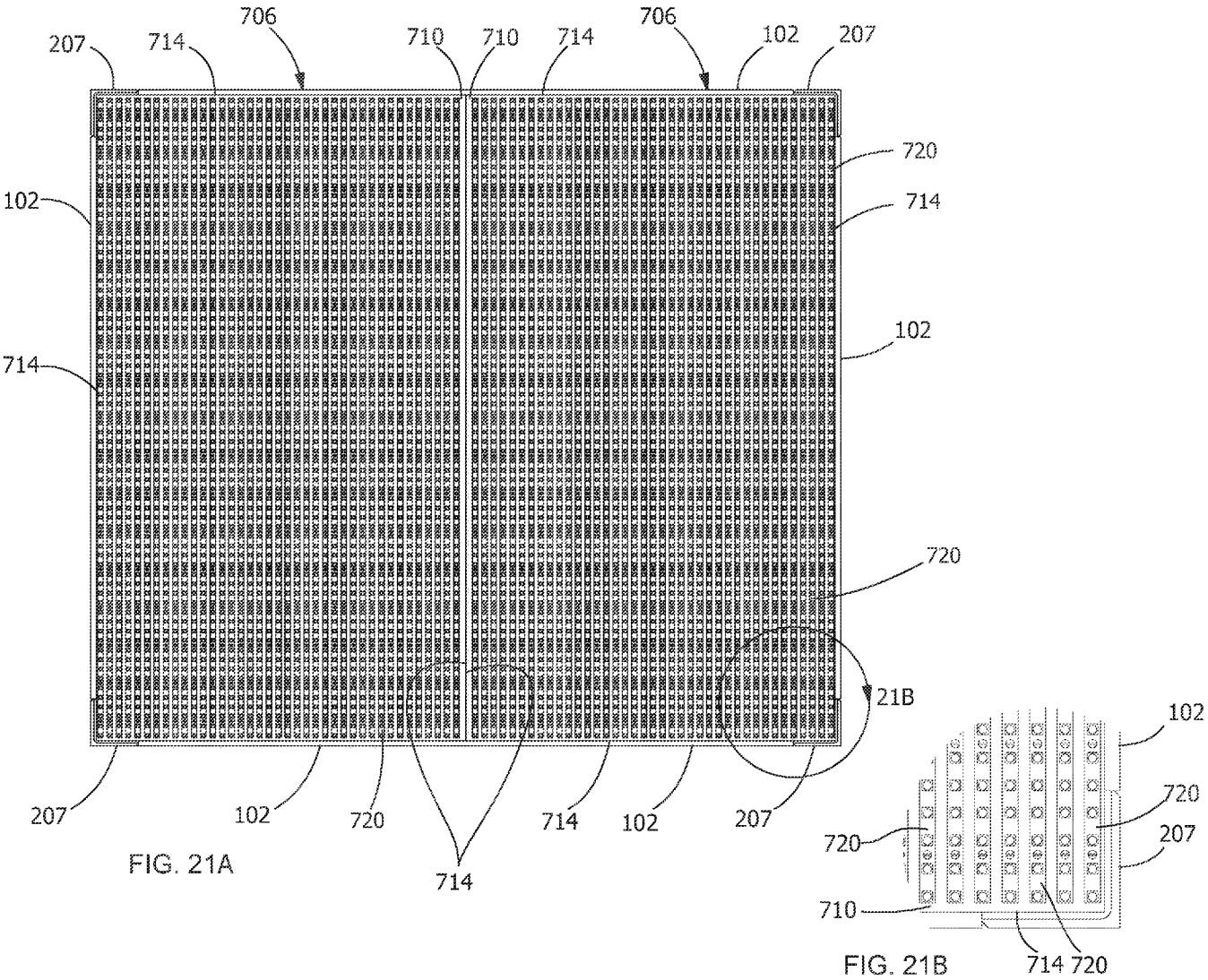
FIG. 21A shows a top view of a module assembly with the deck removed according to the disclosure.
FIG. 21B shows a partial enlarged top view of a module assembly with the deck removed according to the disclosure.
Figure 22:
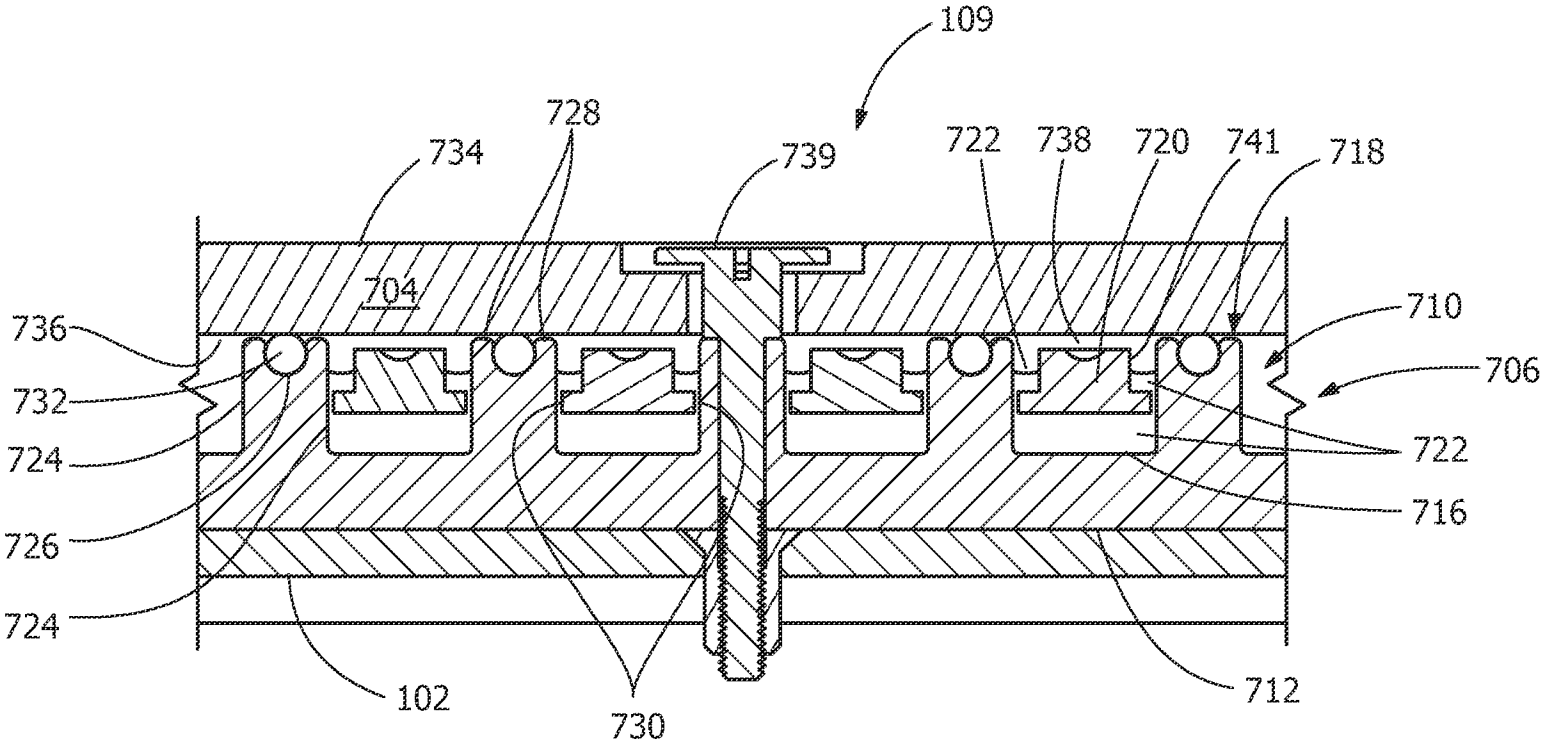
FIG. 22 shows a cross-sectional view of a module according to the disclosure.

Referring to FIGS. 21A-B and 22, in one embodiment, the video module 109 includes a contoured video panel 706. The contoured video panel 706 includes a support portion 710 and a perimeter 714 extending around the support portion 710. During assembly of the platform system 101, the contoured video panel 706 is installed in the module assembly 102 such that one or more sides of the perimeter 714 engage or abut the module assembly 102.

The video module 109 includes an array of light emitting devices 720 (see also FIGS. 21A and 21B). The receiving member 207 is configured to directly or indirectly detachably secure a plurality of the video modules 109. For example, as shown in FIG. 1A, in one embodiment, receiving member 207 directly secures a first video module 109*a* to a second video module 109*b* and/or indirectly secures a third video module 109*c* to the first video module 109*a* and/or the second video module 109*b*. As will be appreciated, in other embodiments, any number of the video modules 109 are capable of being secured by the receiving members 207.

In one embodiment, the receiving members 207 are arranged along the module assembly 102. In one embodiment, the receiving members 207 are attached to the module assemblies 102 by welding and/or by any other suitable attachment, such as, by fastening mechanism.

Referring to FIG. 22, in one embodiment, the support portion 710 includes at least one channel 716 and at least one protrusion member 718. In one embodiment, the channels 716 are arranged to run parallel or substantially parallel to and between the protrusion members 718, to form a contoured surface on the support portion 710.

In one embodiment, the channels 716 are configured to house the light emitting devices 720. In one embodiment, the light emitting devices 720 are LED strips, for example, or any other suitable light emitting devices are capable of producing a moving image or video display. In one embodiment, the light emitting devices 720 are tri-color LEDs. In one embodiment, the light emitting devices 720 are secured within the channels 716 by mounting material 722, for example, or any other suitable material that provides heat dissipation, attachment, and vibration isolation. In one embodiment, the video module 109 includes an array of light emitting devices 720 arranged and disposed in a predetermined pattern. In one embodiment, a plurality of the light emitting devices 720 are arranged and disposed to provide coverage of a majority of the planar surface area of the support portion 710.

In one embodiment, the protrusion members 718 include opposing sidewalls 724, and at least one groove 726 formed within opposing surface ridges 728. In one embodiment, the light emitting devices 720 are arranged and disposed within the channels 716 such that their longitudinal edges 730 abut the sidewalls 724 on either side of the channels 716. In one embodiment, at least one dampening rod 732 is arranged and disposed in the groove 726. In one embodiment, the dampening rod 732 is removably secured in the groove 726 by a friction fit and/or by any other suitable attachment, such as, by adhesive, fasteners, or by tactile surface adhesion. In one embodiment, the groove 726 and surface ridges 728 are configured in any suitable geometry to receive the dampening rod 732. In one embodiment, the ratio of the thickness of the deck 704 to the thickness of the protrusion members 718 is between about 0.75 to about 2, between about 1 and about 2, between about 1 and 1.5, between about 1.5 and about 2, or any suitable combination or sub-combination thereof.

The deck 704 includes an exposed surface 734 and a concealed surface 736. In one embodiment, the dampening rod 732 and the surface ridges 728 are capable of maintaining a space gap 738 between the concealed surface 736 and the upper portion 741 of the light emitting devices 720. The space gap 738 provides heat dissipation and clearance protection for the light emitting devices 720. In one embodiment, the dampening rod 732 and the surface ridges 728 are capable of providing vibration dampening at the concealed surface 736 which reduces noise and impact stresses transmitted by and through the deck 704. In one embodiment, the dampening rods 732 are configured to elevate the deck 704 above the surface ridges 728. In one embodiment, the deck 704 is attached to module assembly 102 by fasteners 739 (see also FIG. 20), for example, or by any other suitable attachment.

Figure 23:
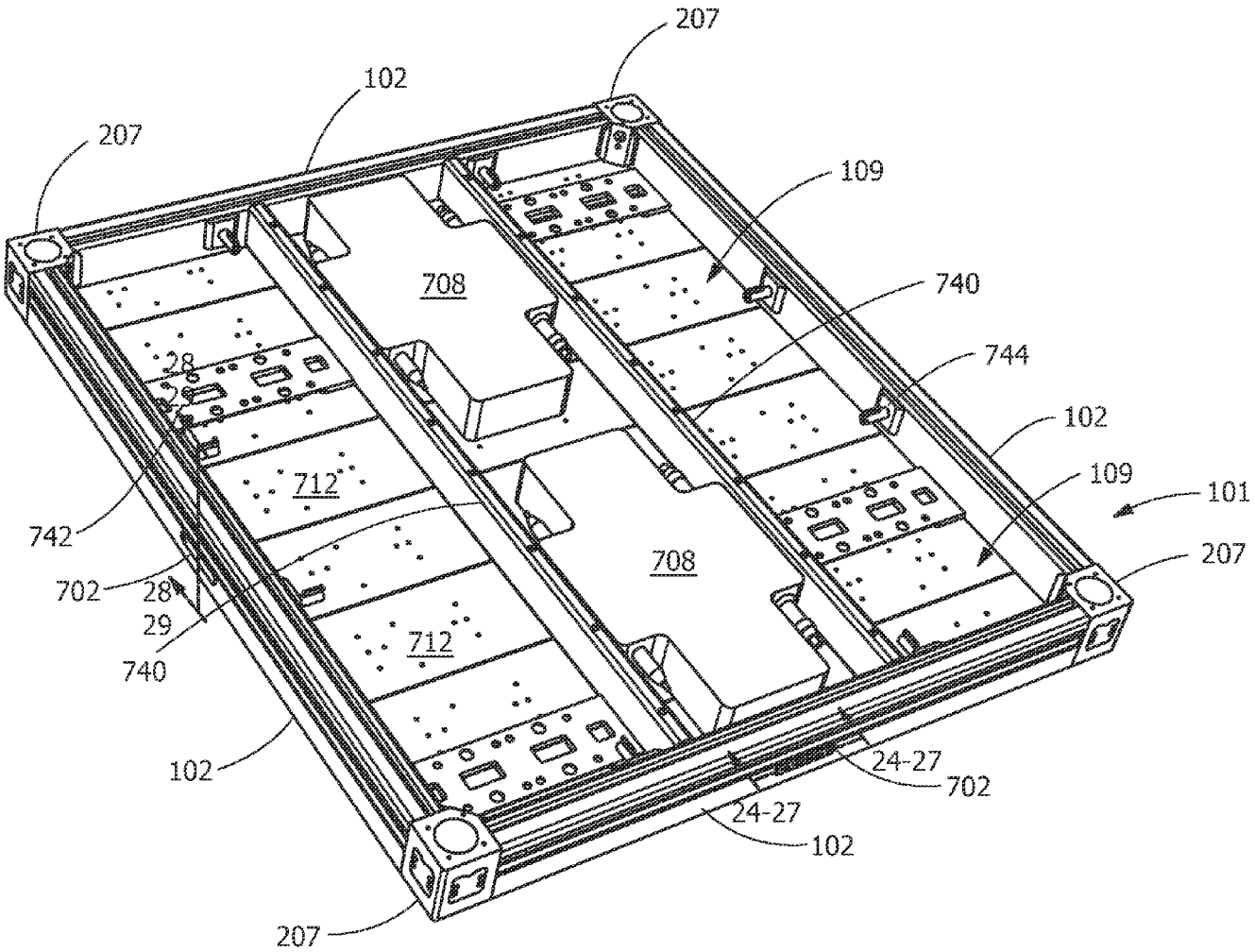
FIG. 23 shows a rear perspective view of a module assembly according to the disclosure.

Referring to FIG. 23, in one embodiment, the module assembly 102 includes at least one cross member 740 arranged and disposed substantially perpendicular to two oppositely disposed members of the module assembly 102. The cross members 740 are configured to engage and support the video module 109 and to provide rigidity and bracing for the module assembly 102. In one embodiment, the module assembly 102 includes at least one support plate 742 arranged and disposed substantially perpendicular to and between the module assembly 102 and the cross members 740.

In one embodiment, the module assembly 102 and the receiving members 207 include exterior flanges 746 and 748, respectively. The exterior flanges 746 and 748 combine to form an edge 750 of the module assembly 102. During assembly of the platform system 101, the contoured video panel 706 is installed in the module assembly 102 such that one or more sides of the perimeter 714 engages or abuts the edge 750.

Figure 30:
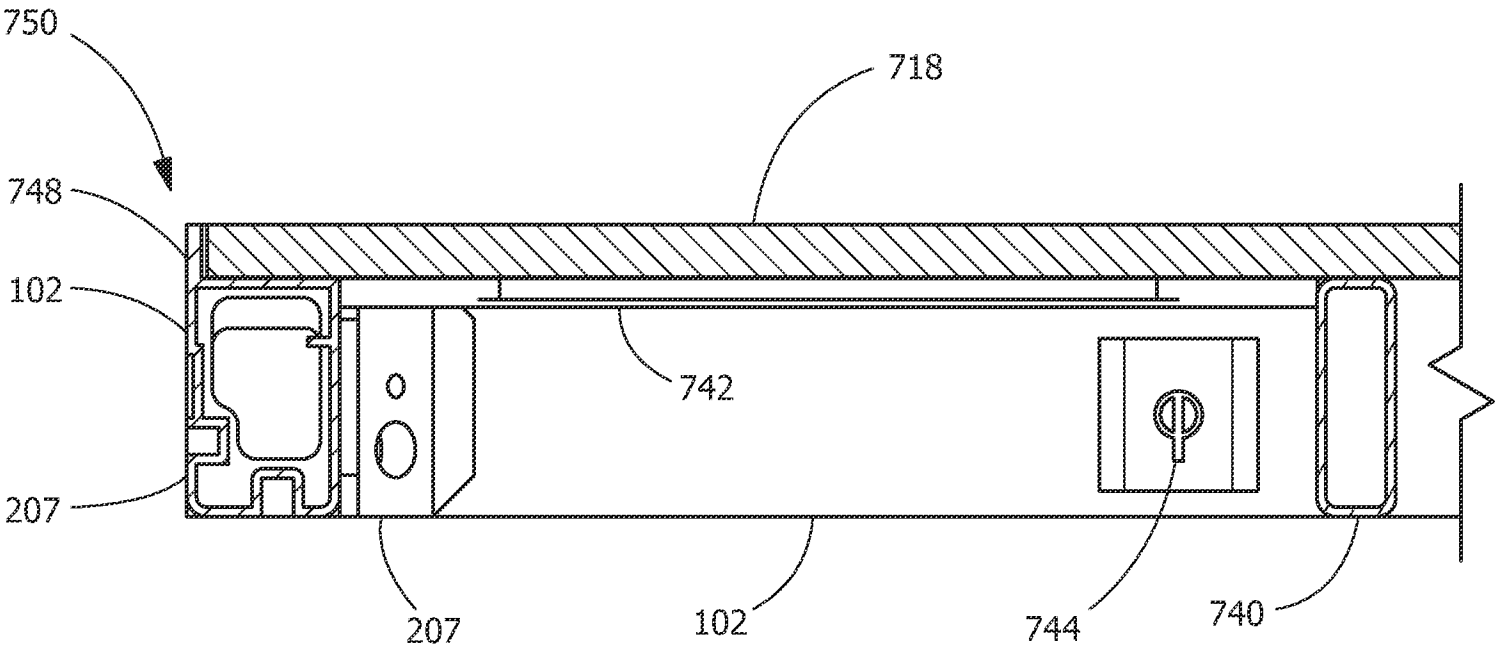
FIG. 30 shows a cross-sectional view of a module assembly according to the disclosure.

Referring to FIG. 30, in one embodiment, the control panel 708 is configured to engage with and be removably secured to the control surface 712 of the contoured video panel 706. In one embodiment, the control panel 708 is arranged and disposed on the control surface 712 such that the control panel 708 aligns between two adjacent cross members 740 during assembly of the platform system 101. The control panel 708 is configured to provide electrical power and control signals to the light emitting devices 720. In one embodiment, a plurality of the control panels 708 are configured capable of being remotely controlled. The remote controlling provides a control sequence to the video modules 109 to produce a predetermined or preprogrammed moving video image through control and sequencing of the individual light emitting devices 720. In one embodiment, the control panels 708 are configured for producing a predetermined or preprogrammed moving video image through control and sequencing of the individual light emitting devices 720. In another embodiment, the light emitting devices 720 are preprogrammed to display video corresponding to a live feed, for example, from a live concert.

In one embodiment, the deck 704 is fabricated of a transparent polycarbonate with a scratch and UV resistant, antireflective coating, or any other suitable durable transparent or semi-transparent or semi-translucent material capable of supporting a predetermined structural load. In one embodiment, the contoured video panel 706 is fabricated of a durable, moldable polymeric material, or any other suitable material capable of supporting a predetermined structural load. The video module 109 is configured to support predetermined structural loads that may include loads received from forces transmitting by performers' and/or equipments' weights or performance impacts. The protrusion members 718, channels 716, and dampening rods 732 are configured with any suitable structural geometry to form a contoured surface on the support portion 710 that can deform or deflect in support of both the normal and the lateral components of forces applied to the deck 704 while maintaining clearance protection of the light emitting devices 720. The deformation or deflection capability of the video module 109 provides vibration and noise dampening.

In one embodiment, the dampening rod 732 is fabricated of elastomeric material (for example, rubber), or any other suitable material capable of providing vibration and noise dampening. In one embodiment, the dampening rod 732 is of an elongated cylindrical shape, but may have other suitable cross sections, such as oval, oblong, rectilinear, or triangular. In one embodiment, the dampening rod 732 is a composition applied in a fluid, gel, or foam, or any other suitable form that partially or substantially fills the groove 726 and is capable of being deformed when loaded in use. In one embodiment, the dampening rod 732 includes interior or exterior protrusions, such as ridges or ribs for structural or dampening support. In one embodiment, the dampening rod 732 includes interior support bracing structure, such as an interior linear wall. In one embodiment, the dampening rod 732 cross section is a biased undulating shape, such as an "S", "Z", "M" or other similar shape.

The platform system 101 is capable of attachment to the supports 103 and the laterally stabilizing supports 105 to form the platform system 101 (see FIGS. 1 and 14A). The receiving members 207 are configured for quick connection to the supports 103 to provide for quick assembly or quick change out of the platform systems 101.

The supports 103 include any suitable material. In one embodiment, one or more of the supports 103 is a lightweight material (for example, lighter than stainless steel) and/or a durable material (for example, having a durability comparable to stainless steel) that can withstand external environmental conditions (for example, rain, snow, sleet, freezing rain, hail, wind, temperature shifts from below freezing to above freezing, temperature shifts from below freezing to 100 degrees Fahrenheit, any other conditions, or any combination thereof).

In one embodiment, one or more of the supports 103 includes a coating or is of a material capable of receiving a coating without delamination of the coating. Additionally or alternatively, in one embodiment, the supports 103 have substantially identical dimensions and/or are identifiable by colors or other suitable representations to reduce or eliminate assembly errors.

The receiving member 207 of the support 103 is capable of being detached and reattached, for example, by hand and/or by tool, from the elongate portion 201. For example, in one embodiment, grooves, features, and interlocking features are utilized to provide engagement between the elongate portion 201 of the support 103 and receiving member 207. The laterally stabilizing support structure 107 is capable of being secured, for example, by hand and/or by tool, to a laterally stabilizing support 105. The receiving member 207 and/or the laterally stabilizing support 105 directly or indirectly engage the video module 109.

Figure 2:
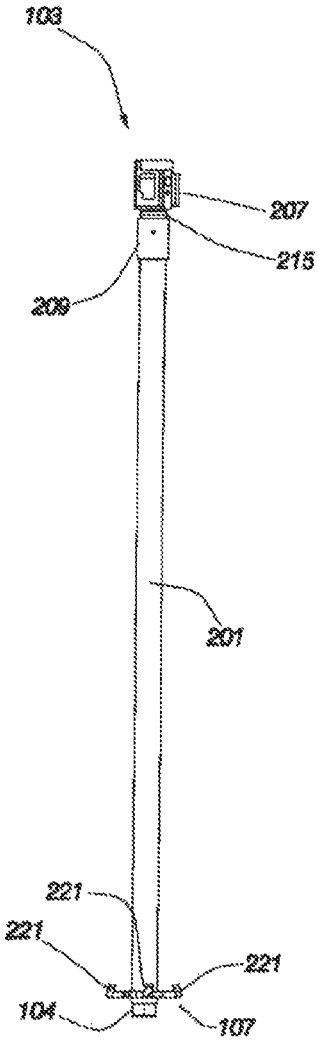
FIG. 2 shows an elevational view of a support according to the disclosure.
Figure 3:
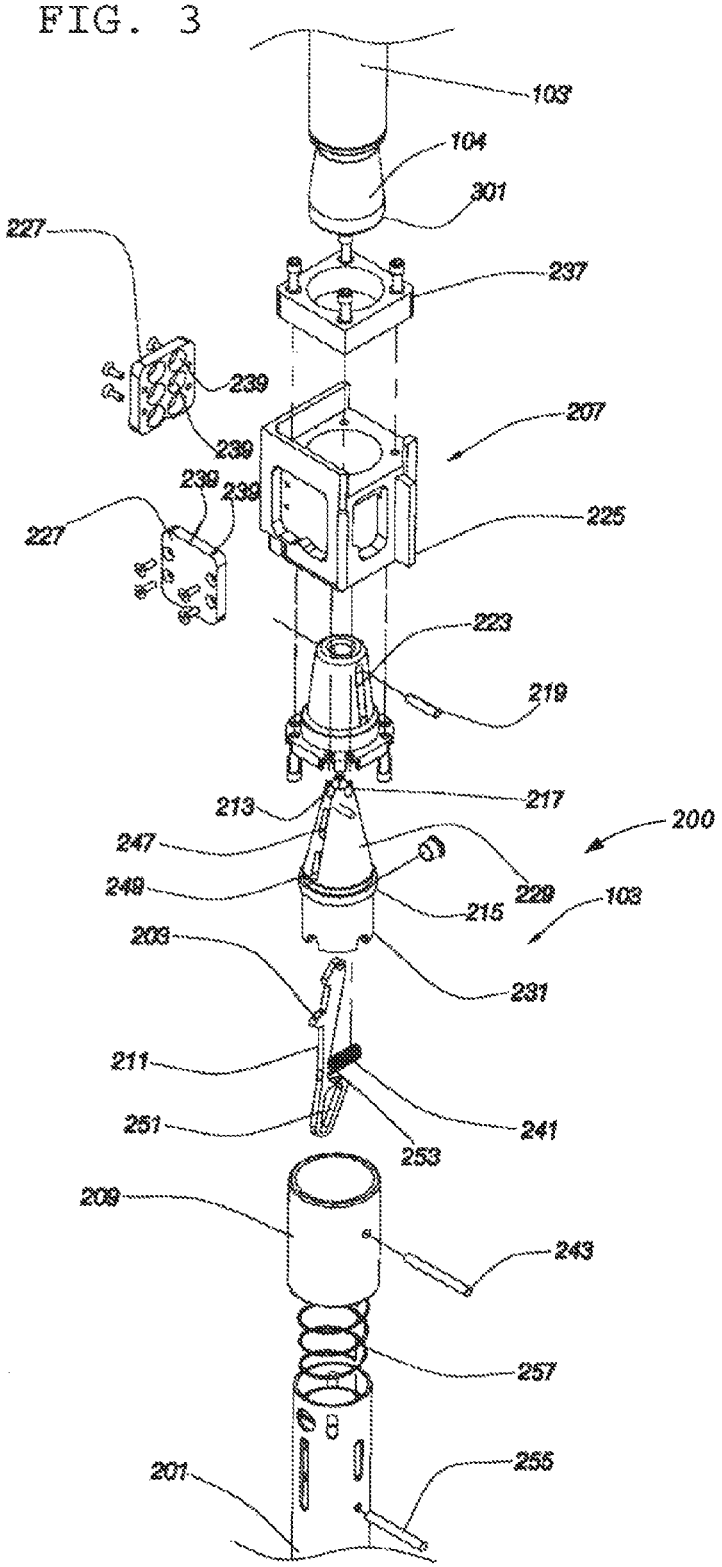
FIG. 3 shows an exploded view of a support, and a corresponding receiving member according to the disclosure.

FIGS. 2 and 3 shows an embodiment of the support 103 engaged with a receiving member 207. In the embodiment, the support 103 includes the elongate portion 201, a locking mechanism 200, and a footing structure 104. The support 103, as shown in FIG. 2, is substantially a cylindrical support but could be of any geometry capable of supporting the module assembly 102 and video modules 109 and loads provided thereon.

Figure 4:
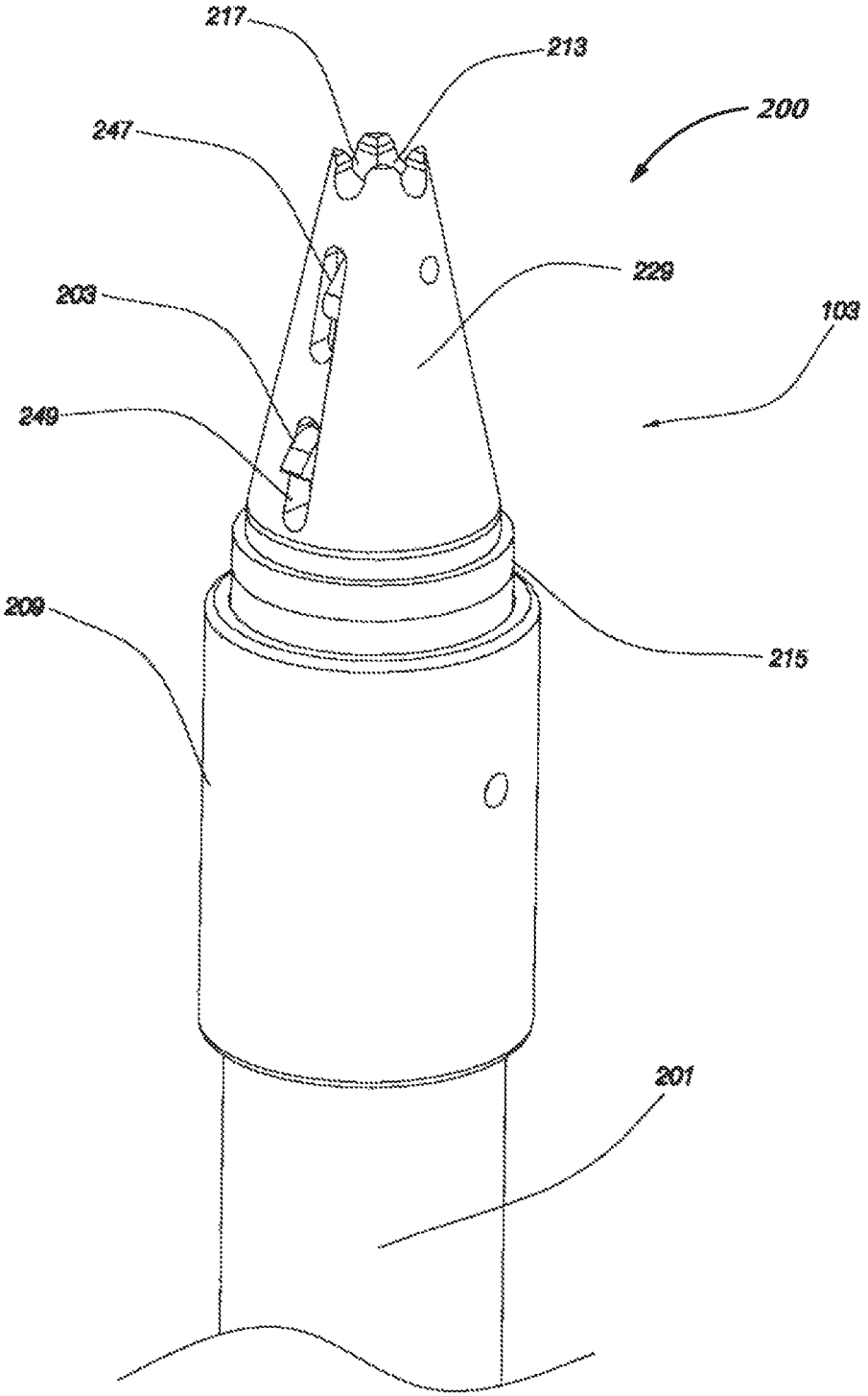
FIG. 4 shows a partial view of a support locking mechanism according to the disclosure.

Referring to FIG. 4, in one embodiment, a tapered portion 229 of the support 103 is attached to or unitarily formed at an end of the elongate portion 201. Additionally or alternatively, the footing structure 104 is attached to an end of the elongate portion 201 opposite tapered portion 229. As shown in FIG. 2, the tapered portion 229 engages the receiving member 207.

Referring to FIG. 3, in one embodiment, the locking mechanism 200 includes a retention device 211, a latching feature 203, an alignment member 213, a flange 215, a tapered portion 229, an attachment portion 231, and one or more channels 217.

In one embodiment, as shown in FIG. 1A, the supports 103 of the platform system 101 in the single level portion 113 include the locking mechanism 200. As shown in FIG. 3, in one embodiment, the locking mechanism 200 is capable of being positioned in multiple orientations by lining up channel 217 with the pin 219 of the receiving member 207.

In one embodiment, the support 103 includes a releasing mechanism 209 arranged along a surface of the elongate portion 201. In one embodiment, the releasing mechanism 209 is arranged as a sleeve or otherwise gripable structure that is manipulatable by hand and/or is capable of being operated by hand to disengage the retention device 211 and the latching feature 203.

In one embodiment, the latching feature 203 is or includes a latch, protrusion, or other feature of the retention device 211 that engages one or more surfaces of the receiving member 207. For example, in one embodiment, the latching feature 203 extends through the tapered portion 229 and provides a surface extending therefrom that is capable of engaging a surface of the receiving member 207. In one embodiment, a series of mounting pins 243 and springs 241 are operably mounted to provide the releasably pivotable structure of the retention device 211 and the releasing mechanism 209. However, the structure of the support is not limited to the particular arrangement shown in FIG. 3.

In one embodiment, the locking mechanism 200 includes a retention device 211 and the latching feature 203, an attachment portion 231, and the alignment member 213, which further comprises at least one channel 217. In one embodiment, the tapered portion 229 is capable of being manually inserted into the receiving member 207. Upon inserting the tapered portion 229 into the receiving member 207, a pin 219 in the receiving member is lined up with the channel 217 in the locking mechanism 200 to position the orientation of the locking mechanism 200 in relation to the receiving member 207. In one embodiment, the locking mechanism 200 produces an audible clicking noise indicating that it is properly engaged to the receiving member 207. Upon fully inserting the locking mechanism 200 into the receiving member 207, the retention device 211 engages a catch in the receiving member 207. The catch is a hole, a slot, a groove, a notch or any other structure or feature allowing for the latching feature 203 to releasably attach lip 218 of the receiving member 207. In one embodiment, to disengage the locking mechanism 200, the releasing mechanism 209 is manually adjusted, resulting in the retention device 211 disengaging the latching feature 203 from the receiving member 207.

In one embodiment, the locking mechanism 200 includes a pin 245 secured in the tapered portion 229 that provides a pivotable connection with the retention device 211. In one embodiment, the support includes an upper slot 247 and a lower slot 249 in the tapered portion 229. The upper slot 247 provides visibility of the interior of tapered portion 229 to simplify installation of the pin 245 through the retention device 211. The latching feature 203 extends through the lower slot 249 to permit engagement with the lip 218 (see FIG. 5) on the receiving member 207.

Figure 5:
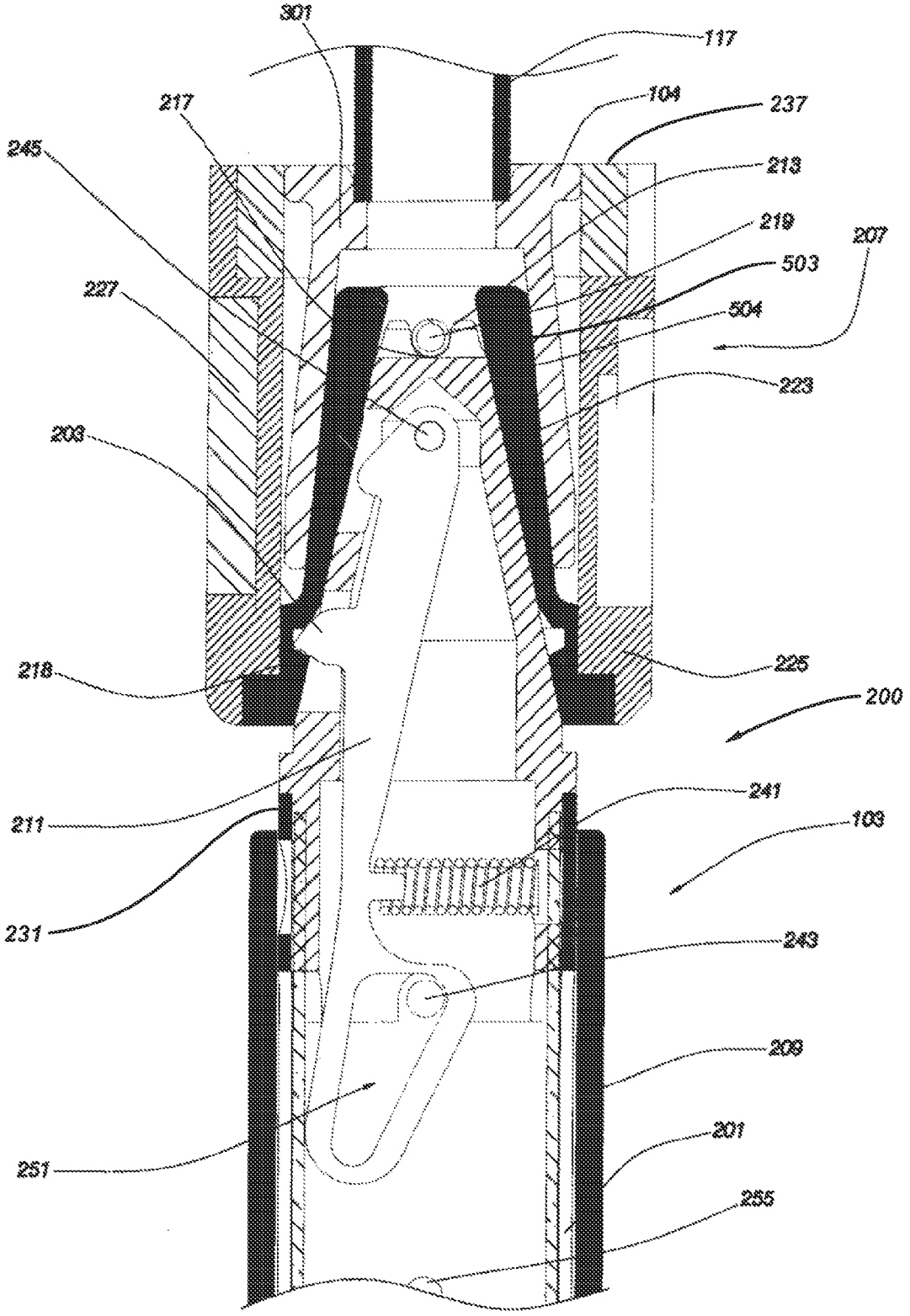
FIG. 5 shows a cross-sectional view of a support in engagement with a receiving member according to the disclosure.

Referring to FIG. 5, in one embodiment, the locking mechanism 200 includes an opening 251 in the retaining device 211 to receive the pin 243 that is secured in the releasing mechanism 209. Disposed between the opening 251 and the latching feature 203 is a protrusion 253 that is configured to receive spring 241. The spring 241 urges the retention device 211 to pivot about the pin 245 so that the latching feature 203 extends through the tapered portion 229. In one embodiment, the locking mechanism 200 includes a spring 257 disposed between a pin 255 secured in the elongate portion 201 and pin 243 secured in the releasing mechanism 209. The spring 257 urges the releasing mechanism 209 to move along the elongate portion 201 toward the tapered portion 229.

In one embodiment, in response to the receiving member 207 being aligned and directed over and into engagement with the tapered portion 229 of the support 103, the inside surface of the support cone 223 makes contact with the latching feature 203. Further directed movement of the receiving number 207 with respect to the support 103 urges the latching feature 203 to pivotably retract through the lower slot 249 sufficiently to permit the latching feature 203 to engage the lip 218. This engagement, normally accompanied by an audible "click", secures the receiving member 207 to the support 103.

In one embodiment, to release the receiving member 207 from the support 103, application of a sufficient force applied to the releasing mechanism 209 in a direction away from the tapered portion 229 urges the releasing mechanism 209 away from the tapered portion 229. The pin 243 engages the opening 251, compressing the spring 241, and urging or actuating the retention device 211 to pivotably move about the pin 245 so that the latching feature 203 recedes within the slot 249. After the latching feature 203 sufficiently recedes to disengage the lip 218, the receiving member 207 is separated from the support 103.

In one embodiment, the tapered portion 229 of the support 103 resembles a tapered or frusto-conical geometry. The tapered portion 229 is not limited to a frusto-conical shape, and is capable of including a conical, pyramidal or other tapered geometry capable of transmitting loads at non-perpendicular angles. The tapered portion 229 provides an angle that allows resistance to lateral forces when engaged with receiving member 207. Further, the tapered portion 229 assists in alignment and ease of assembly.

The attachment portion 231 of the support 103 is attached to the elongate portion 201 in any suitable manner. In one embodiment, the attachment portion 231 is shrink-fitted into a hollow support portion by heating the elongate portion 201 to a temperature sufficient to cause the elongate portion 201 to expand to a diameter sufficient to permit the fitting of the attachment portion 231, wherein the elongate portion 201 is cooled to tighten the connection. In one embodiment, the attachment portion 231 includes a flange 215 to permit attachment of the attachment portion 231 to the elongate portion 201 and alignment of the attachment portion 231 to the receiving member 207 during assembly.

In one embodiment, the receiving member 207 includes a support cone 223, a pin 219, and a casing 225. In one embodiment, the support cone 223 is geometrically configured to allow the locking mechanism 200 to substantially fit within the support cone 223. In one embodiment, the pin 219 is replaceably affixed within the support cone 223 to allow at least one of the channels 217 of the locking mechanism 200 to engage the pin 219. In one embodiment, the casing 225 includes a geometry that allows the support 103 to support the video module 109 (see FIG. 1A), the platform system 101, or other suitable planar or substantially planar surface.

In one embodiment, the casing 225 of the receiving member 207 includes at least one magnetic panel 227. The magnetic panel 227 includes a plurality of magnets 239 that are arranged to magnetically attract adjacent receiving members 207. In one embodiment, the magnetic panel 227 includes six magnets 239 having alternating polarities of north and south. For example, in one embodiment, the magnets 239 are arranged in a north-south-north arrangement in a first set and a south-north-south arrangement in a second, adjacent set. The arrangement of alternating magnetic polarities permits the simultaneous attraction and alignment along multiple directions from receiving members 207 having magnets 239 arranged in a corresponding arrangement.

In one embodiment, the receiving member 207 further includes a pin 219. The pin 219 is of a geometry configured to mate channel 217 of the locking mechanism 200 and provide rotational positioning of the support 103. The locking mechanism 200 includes a single pin 219 or multiple pins 219. The pin 219 has a cylindrical geometry, a cuboid geometry, or any other suitable geometry. In one embodiment, during the initial assembly of the receiving member 207, the pin 219 is inserted into two cavities on opposite sides of the support cone 223. The pin 219 is capable of being removed or replaced allowing the remaining parts of the receiving member 207 to be used if the pin 219 becomes damaged. In one embodiment, the location of the pin 219 in the support cone 223 is as close to the distal end of the support cone 223 in relation to the elongate portion 201 as possible. In another embodiment, instead of having the pin 219, the receiving member 207 is configured with at least one alternate channel corresponding to the channel 217 of the alignment member 213.

In one embodiment, the support cone 223 of the receiving member 207 has a geometry substantially similar to the tapered portion 229, allowing the locking mechanism 200, including the tapered portion 229 and latching feature, to fit inside of the support cone 223 and engage therewith. In one embodiment, the geometry of the support cone 223 resembles a frusto-conical geometry. The support cone 223 is made of a material that can withstand insertion of the locking mechanism 200 without the need to expend significant effort to align the locking mechanism 200 and the support cone 223. In one embodiment, the support cone 223 further includes a geometry to receive a tapered footing structure 104, stairs 115, railing 117, runway ramp similar to the walkout ramp 118 (see FIG. 34), or other suitable structures. The angle of the tapered surface is the same or dissimilar on opposite edges of the support cone 223. In the embodiment with the tapered surface having different angles, the fitting of the components is capable of being verified or customized to particular, predetermined components to prevent mis-assembly with insertion of incorrect components. In one embodiment, the support cone 223 is made of a material that can withstand the impact of the locking mechanism 200 being repeatedly and forcibly inserted into the support cone 223. Upon insertion of the support 103, the mating latching feature 203 of the retention device 211 latches the lip 218 or other surface or feature formed in the receiving member 207.

In one embodiment, the casing 225 of the receiving member 207 is an external portion of the receiving member 207, providing attachment to module assembly 102 and providing structural support for the support cone 223. In one embodiment, the casing 225 is of a cuboid geometry. In one embodiment, the casing 225 has the geometry of a cube, other hexahedron, or any other suitable geometry with a top surface that is substantially planar and at least one side surface that is flat. because the substantially planar surface permits the casing 225 to be placed under the corner of a platform system 101 or under any other part of the platform system 101. In one embodiment, a collar 237 is attached to the casing 225 with fasteners or by other methods and provides alignment of engaging structures and protects the components within and on the receiving member 207. In one embodiment, the collar 237 is fitted with a cap or other structure to conceal the internal components, such as the support cone 223, of the receiving member 207 in the event that it is not desired to include structure on the upper side of the receiving member. The configuration of casing 225 allows for easier assembly of the platform system 101 because the receiving members 207 is capable of being treated as interchangeable and a plurality of module assemblies 102 having receiving members 207 is capable of being brought together.

In one embodiment, the receiving member 207 includes at least one of the magnetic panels 227 on the side surface of the casing 225. The magnetic panel 227 allows for metal plates to be magnetically attached to the casing 225. Otherwise, the metal plates are attached with adhesives or hardware. In one embodiment, the metal plates of the receiving member 207 are attached to multiple casings 225 and provide a front surface for the stage, preventing people from walking underneath the platform system 101 and providing aesthetic benefits. In one embodiment, two flat side surfaces on the casing include the magnetic panels 227. The arrangement allows for the receiving member 207 to be placed under the corner of the platform system 101 or any other part of the platform system 101, allowing for easier assembly of the platform system 101 because the receiving members 207 can be treated as interchangeable.

In one embodiment, the locking mechanism 200 includes the retention device 211, an optional flange 215, the tapered portion 229, and the alignment member 213. The alignment member 213 includes at least one channel 217. The at least one channel 217 is capable of being configured to position the orientation of the locking mechanism 200 and, therefore, the support 103 (see FIG. 1A). To position the orientation of the locking mechanism 200, the channel 217 is lined up with the pin 219 within the receiving member 207. In this embodiment, the attachment portion 231 is within the releasing mechanism 209 inside the elongate portion 201.

In one embodiment, the tapered portion 229 of the receiving member is in engagement with an inner surface 501 of support cone 223. The inner surface 501 of the receiving member 207 support cone 223 includes an angle configured to receive the tapered portion 229. The angle of inner surface 501 is configured to provide a surface that engages the support 103 (see FIG. 1A) and resists lateral movement or flexing. In one embodiment, the platform system 101 includes a footing structure 104 connected to a railing 117 and/or stairs 115. Referring to FIG. 5, in one embodiment, the footing structure 104 is attached to an angled inner surface 504 and is capable of being engaged with an outer surface 503 of support cone 223 of receiving member 207. The outer surface 503 is configured with an angle that provides sufficient engagement and retention of the footing structure 104 that the railing 117, the stairs 115, and/or the or support 103 is substantially prevented from twisting or wrenching out. That is, the footing structure 104 permits unsupported placement of supports 103 into receiving members 207 having lengths of 8 feet or greater, while retaining a substantially perpendicular positioning and resisting tipping or falling over. Such unsupported placement permits the placement of a plurality of the supports 103 prior to providing an additional level of the module assemblies 102 and the video modules 109, wherein additional levels are capable of being lifted onto the unsupported supports 103 with one or only a few personnel. In one embodiment, the outer surface 503 of support cone 223 and the casing 225 include a geometry forming a cavity capable of receiving the corresponding tapered footing structure 104.

Figure 6:
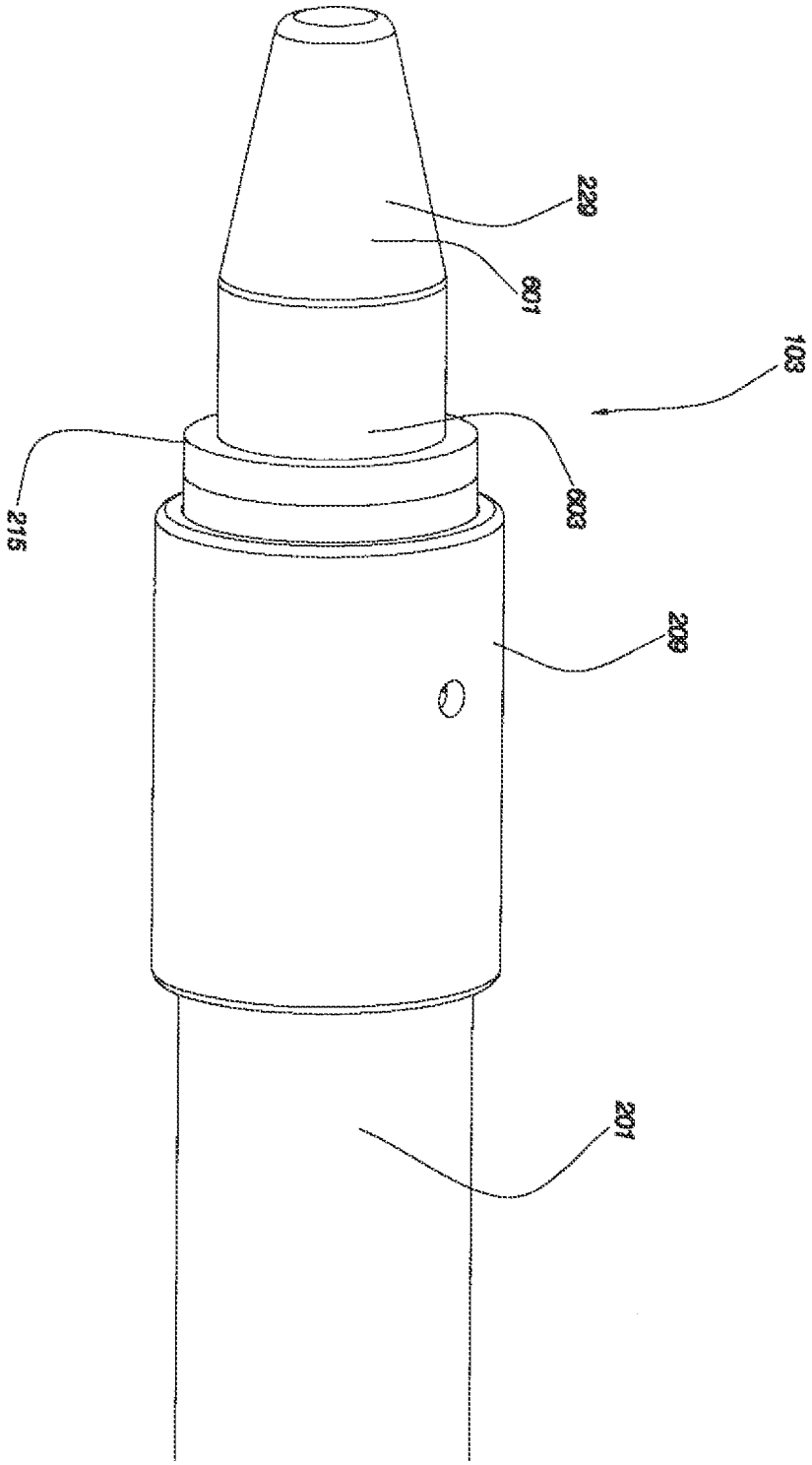
FIG. 6 shows a partial view of a support according to the disclosure.

Referring to FIG. 6, in one embodiment, the tapered portion 229 of the support 103 includes a first taper 601 and a barrel portion 603. The arrangement of support 103 in this embodiment permits the inclusion of addition devices or supports to be engaged with the tapered portion 229. For example, a support having openings corresponding to the barrel portion 603 is capable of being positioned over the barrel portion 603 and locked into place. Such supports are capable of being provided over spans or walkthroughs, for example, where laterally stabilizing supports 105 are undesirable.

Figure 7:
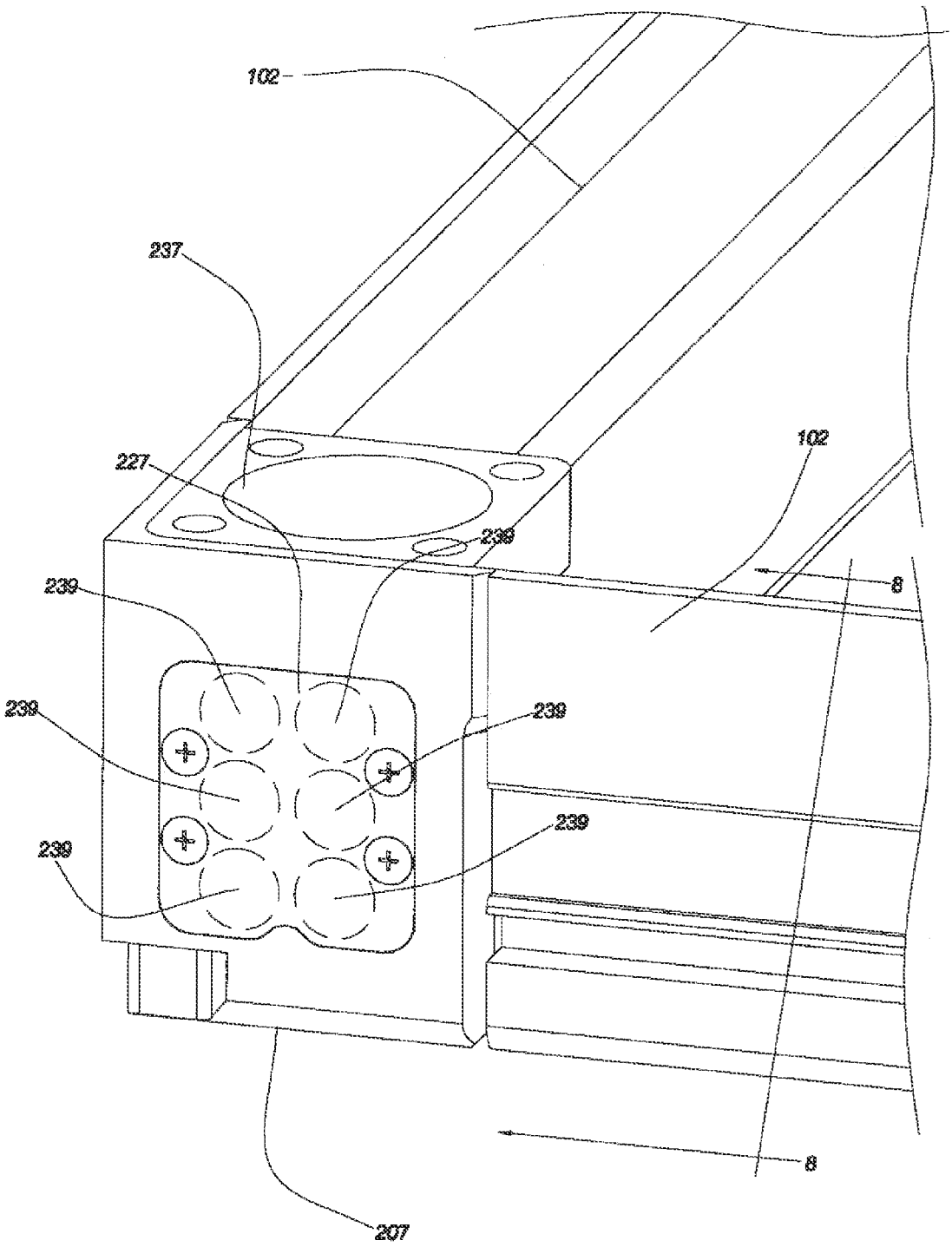
FIG. 7 shows a top perspective view of a portion of a module assembly and receiving member according to the disclosure.

FIG. 7 shows a portion of the platform system 101 with the module assembly 102 attached to the receiving member 207. In one embodiment, the magnetic panel 227 is configured to provide magnets 239 arranged to align and engage adjacent module assemblies 102 and magnetic panels 227. As discussed above, in one embodiment, the magnets 239 are disposed in a north-south-north polarity arrangement to provide the alignment. In addition, as shown, the module assembly 102 is attached to the receiving member 207. The attachment is provided by any suitable attachment technique, including welding, adhesive, fasteners, interlocking or any other attachment that provide sufficient retention to support the module assembly 102, the video module 109, and/or any load thereon.

Figure 9:
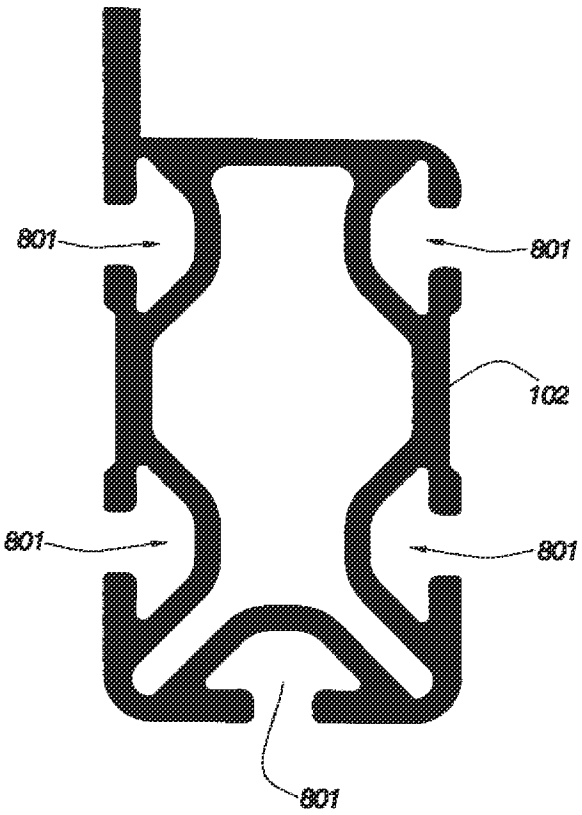
FIG. 9 shows a sectional view of a module assembly according to the disclosure.
Figure 8:
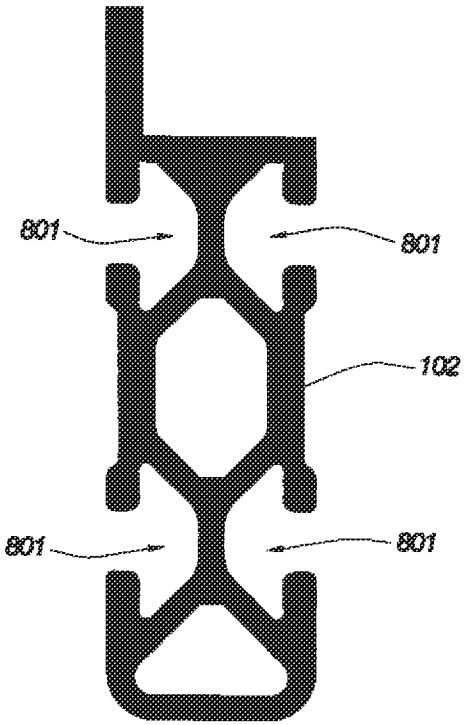
FIG. 8 shows a sectional view of a module assembly according to the disclosure.

Referring to FIGS. 7-9, in one embodiment, the module assembly 102 includes locking cavities 801 into which accessories or other devices are capable of being inserted and locked into position. In one embodiment, such accessories or devices include aesthetic components, theatrical components, structural components, or any other components useful for attachment to module assembly 102.

FIG. 14A shows a partial exploded view of the platform system 101 of FIG. 1A. As shown in FIG. 14A, the system 101 includes a plurality of the module assemblies 102 supported by supports 103, a plurality of the laterally stabilizing supports 105, and a plurality of the video modules 109 thereon. In addition, the module assemblies 102 each include the receiving member 207. The support 103 in the single level portion 113 includes laterally stabilizing supports 105 that engage the module assembly 102 and the laterally stabilizing support structure 107. The laterally stabilizing supports 105 provide increased resistance to lateral forces. The supports 103 include tapered portions 229, which are received by receiving member 207. To release the supports 103, the releasing mechanism 209 is actuated, preferably by hand, and the support 103 is removed from the receiving member 207. In the multilevel portion 110, the supports 103 include footing structures 104 that have an inward taper (see FIG. 5), which is received by the lower receiving members 207. While the attachment of the tapered footing structures 104 is shown and described as a gravity fit, other attachment are capable of being provided, including latches, fasteners or interlocking features of the mating components.

Figure 15:
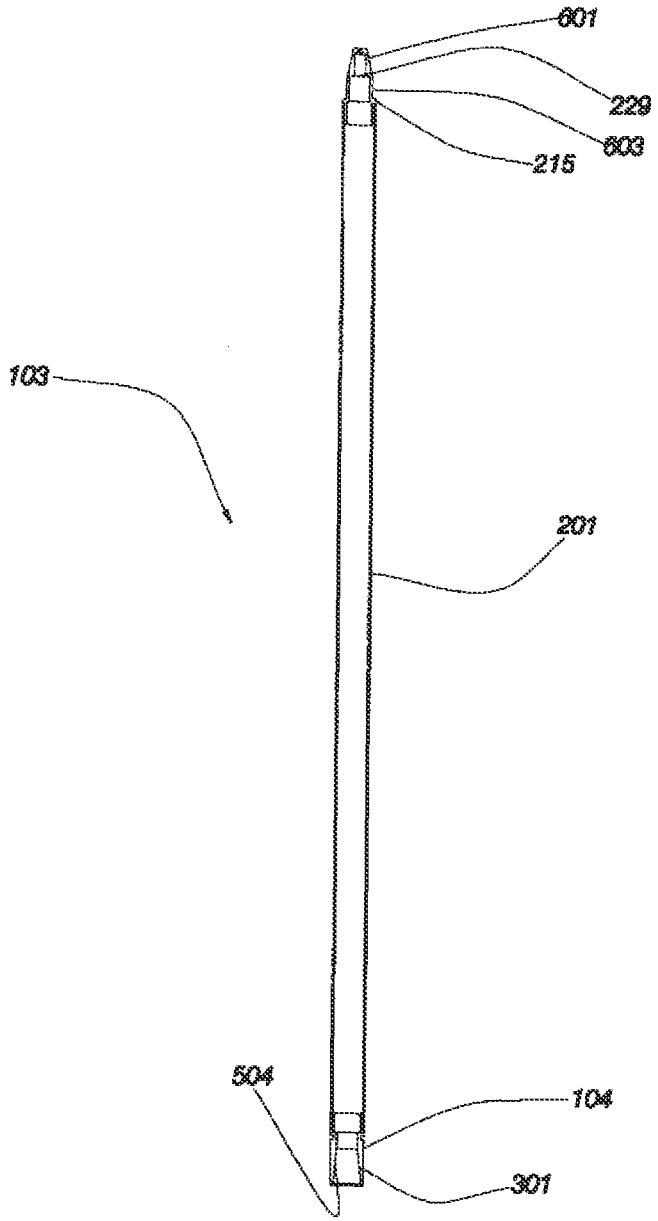
FIG. 15 shows a cross-sectional view of a support according to the disclosure.

FIG. 15 shows an embodiment of the support 103. The support 103 includes a tapered portion 229 and a footing structure 104 having the coupling member 301. The coupling member 301 includes an angled inner surface 504 having an angle that correspondingly mates with the outer surface 503 of support cone 223 of a corresponding receiving member 207 (see FIGS. 5 and 19). The angle of the outer surface 503 and the inner surface 504 is such that the support 103 is capable of maintaining unsupported perpendicular positioning (i.e., substantially perpendicular to video module 109) (see e.g., multiple level portion 110 of FIGS. 1A and 14A), during assembly.

Figure 19:
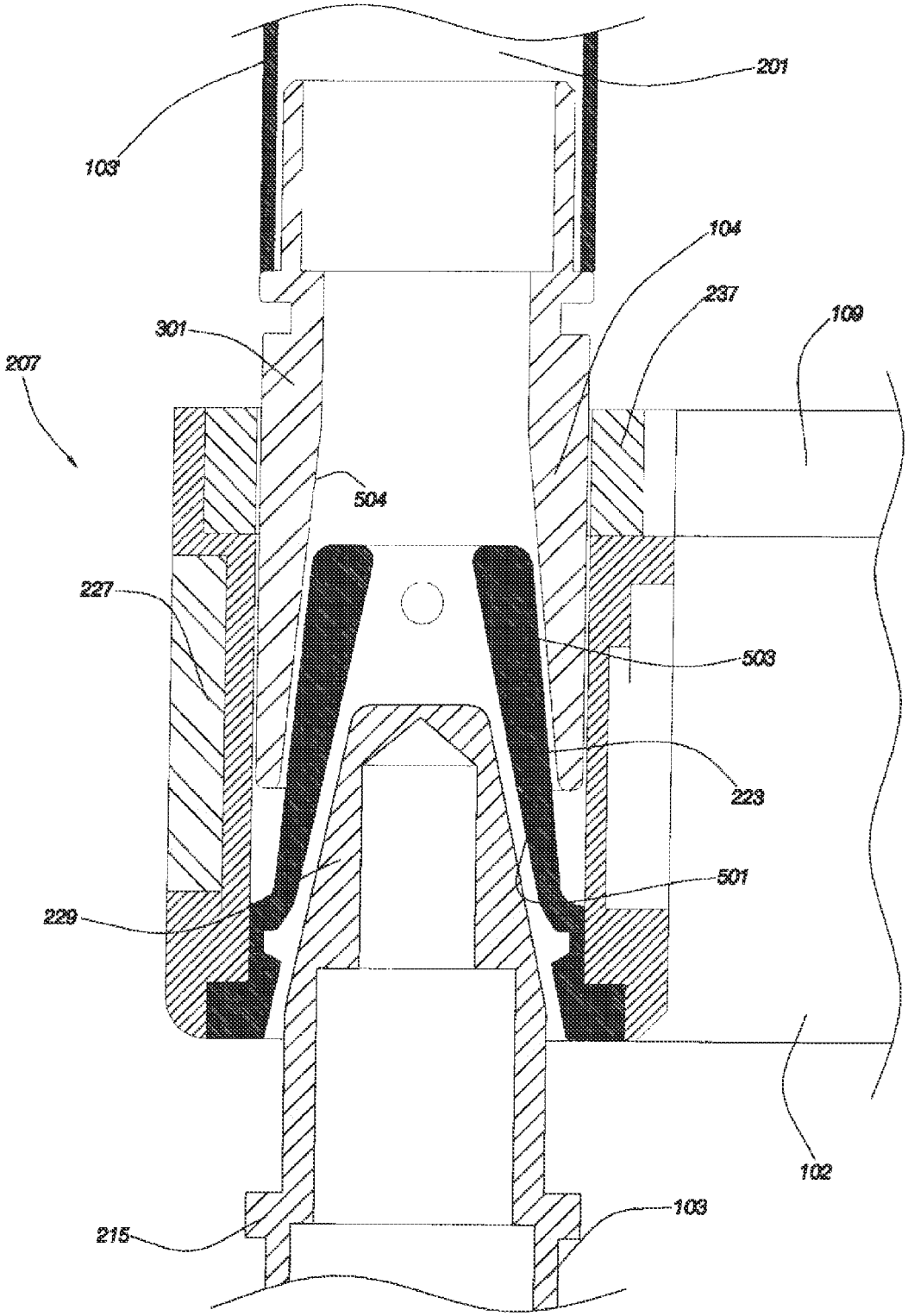
FIG. 19 shows a partial cross-sectional view of a module assembly with supports attached above and below according to the disclosure.

FIG. 19 shows an embodiment of the support 103 connected into a receiving member 207 from below and a second support 103' engaging receiving member 207 from above. In this embodiment, the tapered portion 229 is frictionally engaged with the receiving member 207 and the coupling member 301 is frictionally engaged with the receiving member 207. While the above have been shown with multilevel portions 110 having tapered portions 229 having no latching members 203, the supports 103 of the multiple level portions 110 are capable of also having latching members 203, grooves, features, and interlocking features utilized to further provide engagement between the support 103 and receiving member 207.

In one embodiment, the platform system 101 includes the support 103 attached as part of a fence system (not shown). The fence system is capable of including regular fencing materials, metal sheets, vinyl sheets, plastic sheets, wood panels, or any other material that is able to be affixed to the flat portions of the receiving member 207.

Still another embodiment of the present disclosure includes a platform system 101 with the support 103 attached as part of a scaffolding system (not shown).

FIG. 2 further shows an embodiment of the platform system 101 including the laterally stabilizing support structure 107, having a set of the hook members 221. Hook members 221 are arranged to permit at least one of the laterally stabilizing supports 105 to be attached to the laterally stabilizing support structure 107 allowing increased stability for the platform system 101. The engagement of the locking mechanism 200 with the receiving member 207 includes a rotational positioning that arranges the hook members 221 in an orientation that permits placement and locking engagement of the laterally stabilizing supports 105 to the support 103 and to the module assembly 102. The laterally stabilizing supports 105 are capable of being fastened to the module assembly 102 in any suitable manner, including by fasteners, latches, hooks or other clipping or retaining structures.

Referring to FIG. 2, in one embodiment, the laterally stabilizing support structure 107 is attached circumferentially to the elongate portion 201. In an embodiment, the laterally stabilizing support structure 107 is positioned at or near the end of the support 103 opposite the receiving member 207. The laterally stabilizing support structure 107 is capable of being positioned anywhere on the elongate portion 201. In one embodiment, the laterally stabilizing support structure 107 is positioned at or near the end of the support 103 opposite the receiving member 207, providing increased stability. In another embodiment of the laterally stabilizing support structure 107 includes a hook member 221 (see FIG. 12). The hook member 221 allows for at least one laterally stabilizing support 105 to be attached to the support 103, allowing increased stability for the platform system 101 (see FIG. 1A).

Referring to FIG. 1A, in one embodiment, the laterally stabilizing support 105 is attached to the laterally stabilizing support structure 107 and to another structure. For example, the other structure is a fitting on the module assembly 102 of the stage or platform system 101, another laterally stabilizing support structure 107 on another support 103, a fitting on another support 103, or a fitting on an additional support. In one embodiment, the laterally stabilizing supports 105 are engaged and secured by the support locks 744 (see support locks in FIG. 23). In one embodiment, the laterally stabilizing support structures 107 are located at ninety degrees, circumferentially, on the support 103 (see FIG. 12). In one embodiment, the laterally stabilizing supports 105 for the internal supports 103 are attached to four laterally stabilizing supports 105 radiating from the support 103. In one embodiment, there are two laterally stabilizing supports 105 on the supports 103 located on the corner of the platform system 101. In one embodiment, there are two laterally stabilizing supports 105 on the supports 103 that are on the outside perimeter of the platform system 101. This configuration of the laterally stabilizing supports 105 permits stability with a minimal amount of obstruction. Nonetheless, any or all of the laterally stabilizing supports 105 are capable of being removed.

Figure 12:
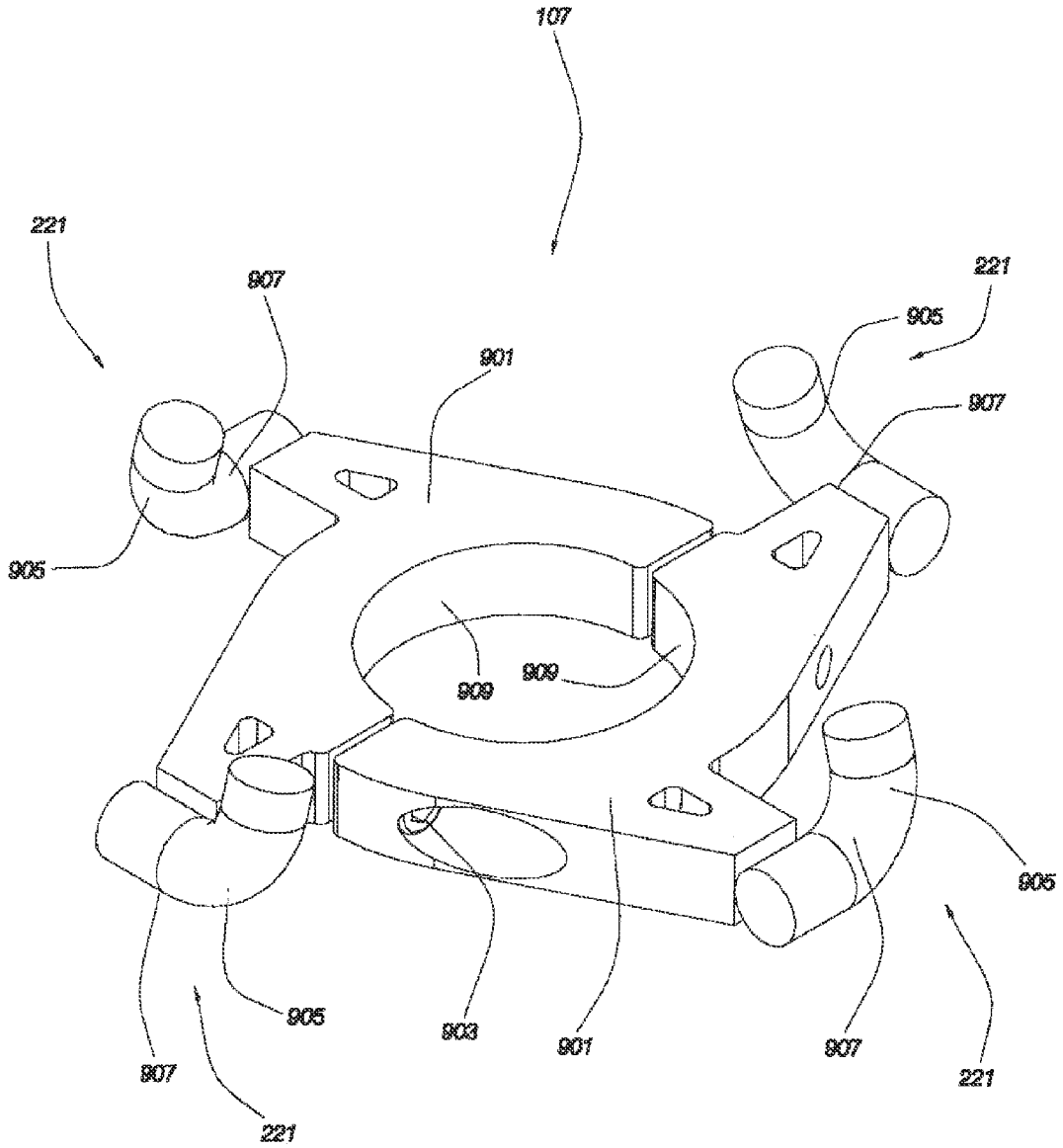
FIG. 12 shows a top perspective view of a laterally stabilizing support structure according to the disclosure.

FIG. 12 shows the laterally stabilizing support structure 107 including a plurality of hook portions 221. The hook portions 221 extend from a laterally stabilizing support structure attachment portion 901. The laterally stabilizing support structure attachment portion 901 includes a geometry that is suitable for attachment to the support 103. The attachment portion 901 embodiment shown in FIG. 12 includes a pair of clamp-like structures that are fastened together by fasteners 903. The attachment portion 901 includes an attachment surface 909 that attaches to the support 103 (see FIG. 2) upon sufficient engagement of fasteners 903 to draw the attachment surfaces 909 into compressive contact with the support 103. In one embodiment, the compressive contact is achieved with a connector of fastener that constantly provides an inward force. The attachment portion 901 is not limited to the geometry shown in FIG. 12. For example, in one embodiment, the attachment 901 includes a geometry that permits the attachment of the laterally stabilizing support structure 107 to the support 103. In one embodiment, the attachment of the laterally stabilizing support structure 107 to the support 103 takes place using any suitable method, including frictional attachment provided by fasteners 903, adhesive, thermal shrink fit, welding or providing a unitary support 103 having the structure of the laterally stabilizing support structure 107 integrally included. Although FIG. 12 shows four hook portions 221. In other embodiments, the laterally stabilizing support structure 107 includes any number of hook portions 221 and includes a hook portion 221 for each elongate portion 103 that is in locking engagement with the laterally stabilizing support structure 107. Additionally, in one embodiment, the laterally stabilizing support structures 107 is fabricated with a symmetrical arrangement of hook portions 221, such as the four hook portions 221 shown in FIG. 12, for ease of assembly and alignment of the support 103 when the platform system 101 is assembled. In one embodiment, the hook portions 221 include a curved portion 905 that has a radius of curvature that allows a laterally stabilizing support connector 1301 of a laterally stabilizing support 105 (see FIGS. 13A and 13B) to be directed over the hook portion 221. The curved portion includes an engagement surface 907 that is capable of engaging the laterally stabilizing support connector 1301 and reacting to forces transmitted through the laterally stabilizing support 105. When the laterally stabilizing support connector 1301 is in position and in engagement with the engagement surface 907, the curved portion 905 locks the laterally stabilizing support connector 1301 in place and prevents disengagement, thereby retaining the laterally stabilizing support 105 in locking engagement.

Figure 13A:
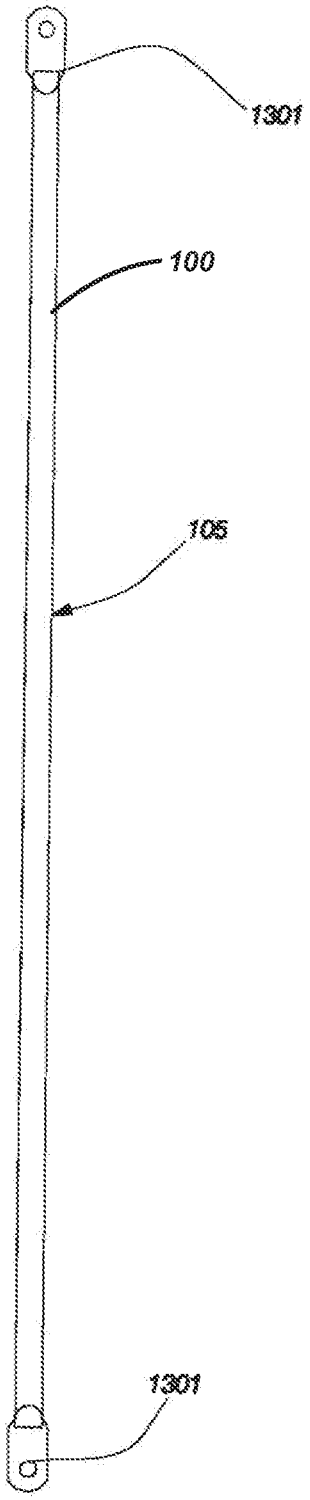
FIGS. 13A and 13B show orthogonal views of a laterally stabilizing support according to the disclosure.
Figure 13B:
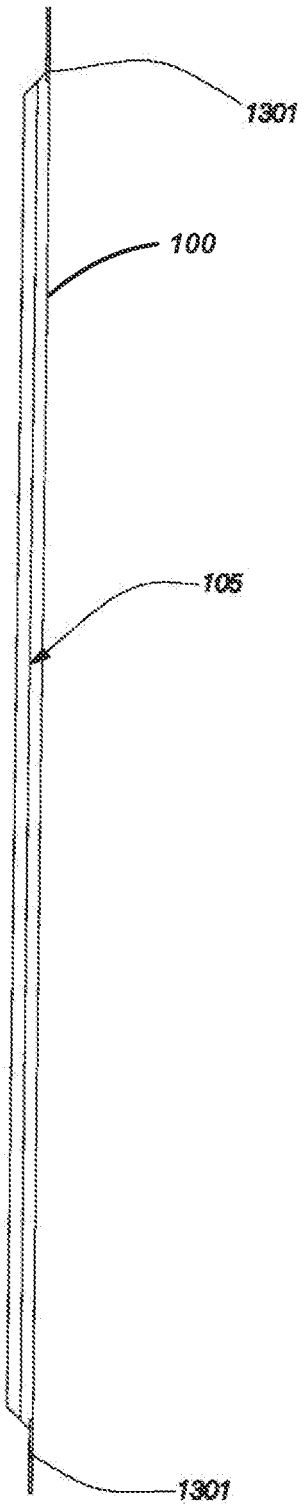

FIGS. 13A and 13B illustrate two orthogonal views of the laterally stabilizing support 105 according to an embodiment of the invention. In one embodiment, the laterally stabilizing support 105 includes the elongate portion 100 having a substantially cylindrical geometry, and two laterally stabilizing support connectors 1301, disposed, one at each opposing end. In one embodiment, the laterally stabilizing support 105 includes any suitable geometry capable of transferring force from the module assembly 102 to the supports 103 when the platform system 101 is assembled (see FIG. 1A). As discussed above with respect to FIG. 1A, in one embodiment, the laterally stabilizing support connectors 1301 include any structure, such as eyelets, for example, that is suitable for engaging the module assembly 102 and the laterally stabilizing support structure 107 on the support 103. The laterally stabilizing support structure at each end of the laterally stabilizing support 105 are the same configuration, or the laterally stabilizing support connector 1301 connectors have different configurations from each other. In addition, the laterally stabilizing support connector 1301 is capable of being configured in any suitable geometry that includes one end that is capable of detachably engaging the module assembly 102 and one end that is capable of being in locking engagement to the laterally stabilizing support structure 107.

Figure 10:
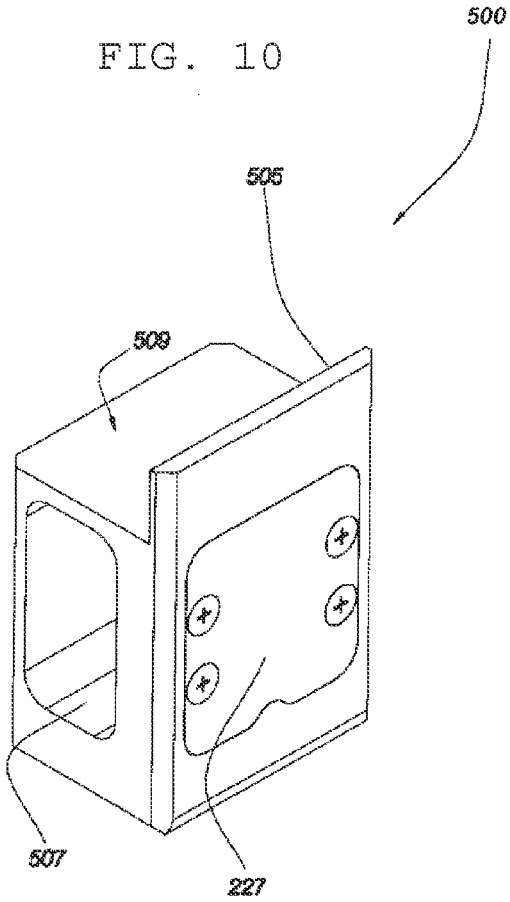
FIG. 10 shows a top perspective view of a casing attachment according to of the disclosure.
Figure 11:
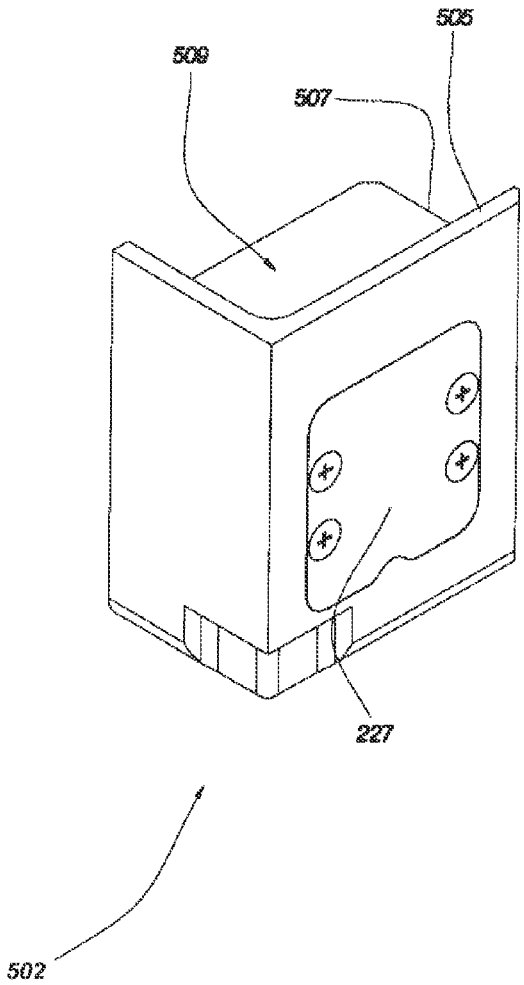
FIG. 11 shows a top perspective view of a casing attachment according to the disclosure.

FIGS. 10 and 11 show additional support structure to attach to or otherwise engage module assembly 102. The additional support corresponds to the structures selected from the group consisting of a longitudinal casing attachment 500, a latitudinal casing attachment 502, and any combinations thereof. The longitudinal casing attachment 500 (see FIG. 10) includes the casing attachment panel 505, which in one embodiment is the magnetic panel 227, as shown and described above in FIG. 3, and the alternative support slot 507. The latitudinal casing attachment 502 (see FIG. 11) includes the casing attachment panel 505 and the alternative support slot 507. In one embodiment, the casing attachment panel 505 includes several screws for attaching the casing attachment panel 505 to the casing 225; however, the casing attachment panel 505 is capable of being attached to the casing 225 by using the magnetic panels 227, an adhesive, welding, or any other suitable method of attachment. The support slots 507 receive module assembly 102 and are supported thereby. The width and height of the additional supports is capable of being modified to fit specific needs of the platform system 101. The longitudinal casing attachment 500 has a narrower width and a taller height. The latitudinal casing attachment 502 has a wider width and a shorter height. The longitudinal casing attachment 500 and the latitudinal casing attachment 502 further include a panel support area 509, which is arranged to receive the video module 109, when the platform system 101 is assembled. In one embodiment, the casing 225 works in conjunction with both the longitudinal casing attachment 500 and the latitudinal casing attachment 502. The alternative support slot 507 has any geometry configured to the additional support. In one embodiment, the alternative support slot 507 includes a rectangular opening permitting a wood plank to be inserted into the alternative support slot 507 as the additional support; however, the additional support can be made of any material sufficient to provide the necessary support.

Referring again to FIG. 1A, in one embodiment, the platform system 101 includes wheels 106, which provide contact with the underlying surface 414 of the platform system 101. In one embodiment, the support plates 742 are configured for attachment of the wheels 106 to the platform system 101. Although wheels 106 are shown, other structures may be utilized including, but not limited to, rollers, fixed feet, rotating feet 412 (see FIG. 34), stakes, posts, or other structures suitable for engaging the surface underlying the platform system 101. As shown in the multilevel portion 110, the wheels 106 are attached to the video modules 109 and/or module assembly 102 to permit rolling or moving of the platform system 101, even after assembly. Likewise, the single level portion 113 includes footing structures 104 having wheels that are attached to the support 103 and permit rolling or moving of the platform system 101, even after assembly. In another embodiment, the footing structures 104 are substituted with a stabilizing device. In one embodiment, the stabilizing device is a device formed of a solid substance (such as concrete, plastic, or other solids that can be worked with in liquid form), a mechanical system providing shock absorption, or other systems sufficient to provide stability for the support 103 and/or module assembly 102.

In one embodiment, the receiving members 207 are configured in the module assembly 102 to permit engagement with supports 103 from either the top surface or from the bottom to permit stacking of platform levels. That is, supports are mated to the receiving member 207 from two directions, permitting the formation of multiple levels. Although the multilevel portion 110 is shown as two platform levels, any number of additional levels are capable of being formed. In addition, the distance between platform levels is capable of being varied by providing supports 103 of varying lengths on each level.

Referring again to FIG. 1A, in one embodiment, the receiving members 207 are configured to engage with additional staging structures desirable for staging or platform use. For example, in one embodiment, as shown in FIG. 1A, additional staging structures, such as the stairs 115, engaged to the platform system 101 by insertion of a portion thereof into receiving members 207. The receiving members can also engage other staging structures, such as a runway ramp, for example, similar to the walkout ramp 118 (see FIG. 34). Likewise, in another embodiment, the railings 117 are inserted into the receiving members 207. The engagement includes any suitable engagement into receiving member 207, including, but not limited to gravity, interlocking, latching or magnetic attraction. In other embodiments, other staging structures are likewise be engaged to the platform system 101 by engagement with the receiving member 207.

In addition, the embodiment shown in FIG. 3 includes a second support 103' extending from the receiving member 207. Although the embodiment shown includes a second support 103', in other embodiments, the stairs 115, the railings 117 or other structures include the footing structure 104 configured to engage support cone 223 of receiving member 207 and engaged with the receiving member 207 (see FIG. 1A).

In one embodiment, the footing structure 104 on the support 103 includes a frusto-conical geometry or similar geometry. Tapered, frusto-conical, and conical geometry of the footing structure 104 on the support allow the support 103 to stand without additional support. This allows additional supports 103 to be positioned on the platform system 101. In one embodiment, once the supports 103 are all positioned and engaged, a second platform system 101 is positioned and engaged at the distal end of the receiving member 207 of the support 103. The second platform system 101 forms the second level for a multilevel portions of the platform system 101. In one embodiment, the process is repeated horizontally and/or vertically to produce a larger platform or stage on multiple levels. Tapered, frusto-conical, and conical geometry of the tapered portion 229 of the support 103 distribute the lateral forces allowing the platform system 101 to maintain stability, without swaying or bending, even when there are lateral forces present. In addition, the tapered, frusto-conical, and conical geometry help prevent misalignment of the support 103 by providing an engagement surface. Also, the support cone 223 aligns itself and allows workers having little or no technical skill to assemble the platform systems 101 quickly and easily. Disassembly is also easily achieved by reversing this process.

Figure 17:
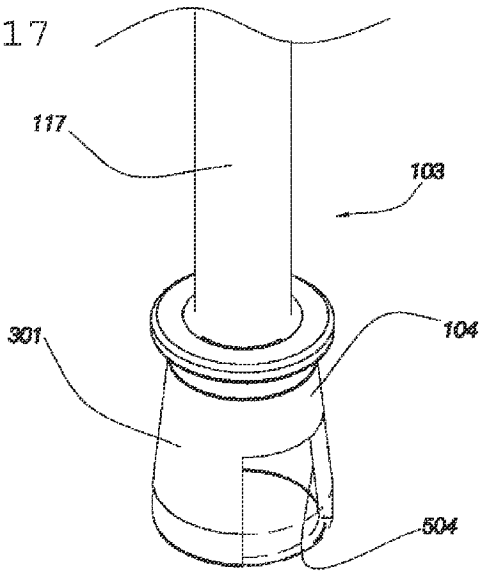
FIG. 17 shows a perspective view of a tapered footing structure according to the disclosure.
Figure 16:
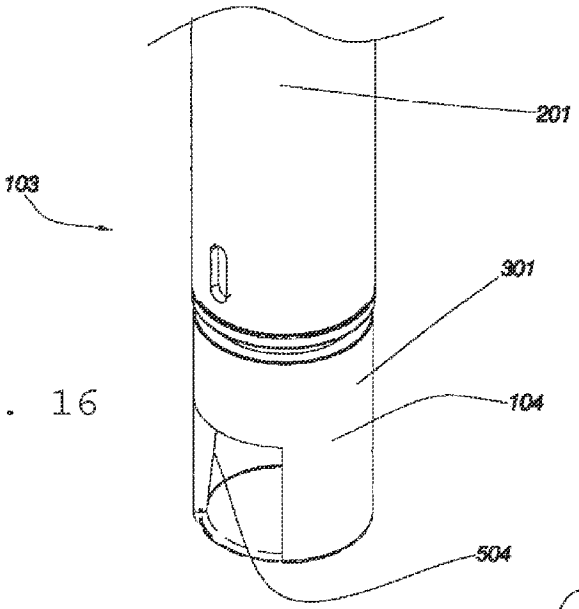
FIG. 16 shows a perspective view of a footing structure according to the disclosure.

FIG. 16 shows the coupling member 301 as the footing structure 104, wherein the coupling member 301 includes an inner surface 504 and attaches to the elongate portion 201. FIG. 17 shows a coupling member 301 as the footing structure according to an alternate embodiment, wherein the coupling member 301 is configured to attach to the railing 117 or be configured to attach to the stairs 115 (see FIG. 1A). In one embodiment, the walkout ramp 118 (see FIG. 34) includes railing similar to the stairs 115 (not shown), and is configured to connect to the main platform system 108 with a module assembly 102 including coupling members 301 (not shown).

Figure 18:
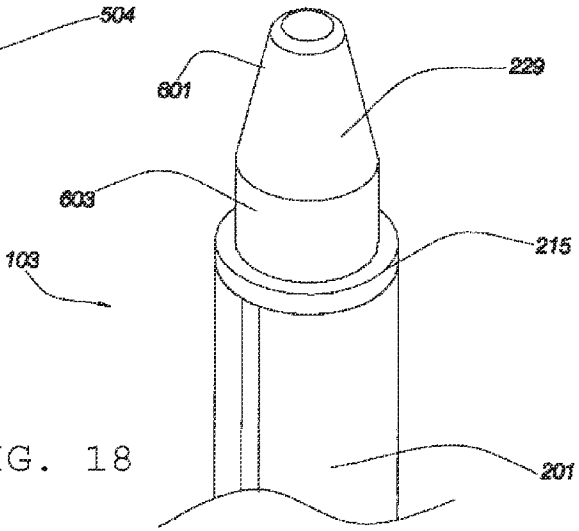
FIG. 18 shows a perspective view of a portion of support according to the disclosure.

Referring to FIGS. 14A and 18, in one embodiment, the multilevel portion 110 includes the support 103 with the tapered portion 229 including the flange 215, a first taper 601 and a second barrel portion 603. The tapered portion 229 is attached to elongate portion 201. During assembly, as discussed above, the supports 103 are preferably positioned, unsupported on a level of video modules 109, module assemblies 102 and receiving members 207. By unsupported, it is meant that all of the support is provided by the engagement of the tapered portion 229 and the support cone 223. A receiving member 207 of an upper level of video modules 109, module assemblies 102 may be positioned over the tapered portion 229 and is permitted to engage.

Figure 36:
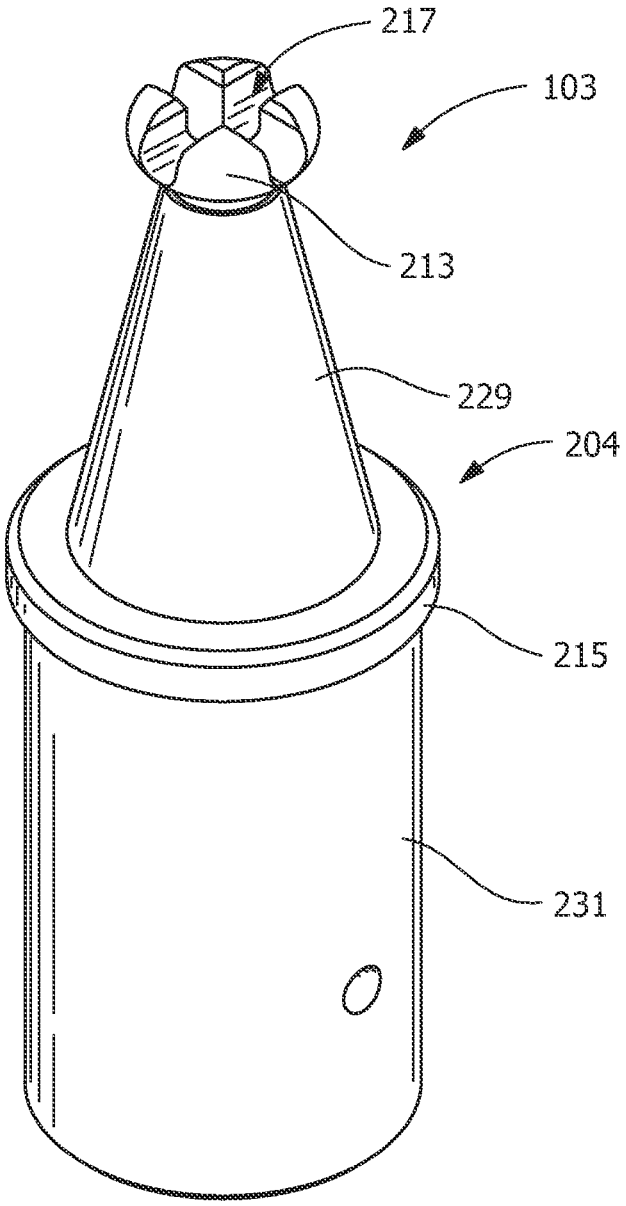
FIG. 36 shows a perspective view of a first end portion of a support according to the disclosure.

Referring to FIG. 36, in an alternate embodiment, the first end 204 of support 103 includes an alignment member 213 with a flared end. In one embodiment, the receiving member 207 includes any suitable retention device (not shown), such as a ball detent assembly, for example, configured to engage the alignment member 213.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A platform system for leveling a stage, the platform system comprising:

a first module assembly and a second module assembly, each of the first module assembly and the second module assembly including one or more receiving members; and one or more supports engaged and removably secured to each of the one or more receiving members, each support comprising:

an elongate portion;

an extendible portion extendible from and lockingly engageable with the elongate portion;

a base member removably attached to the extendible portion; and an actuator assembly having a housing affixed to the elongate portion and an actuator having an actuation force receiving surface and a biasing device positioned within the housing and in communication within the actuator, wherein in response to application of a force applied to the force receiving surface in a direction toward the biasing device, the actuator disengages the extendible portion, allowing gravity to extend the extendible portion downward to engage an underlying surface thereby;

self-leveling of each of the first module assembly and the second module assembly of the stage as the base member engages the underlying surface, wherein the first module assembly and the second module assembly are connected such that the first module assembly and the second module assembly remain connected during the self-leveling.

2. The system of claim 1, further including one or more walkout ramps operative to connect to a main platform system.

3. The system of claim 1, wherein the biasing device is configured to bias the actuator into a locked position, thereby lockingly securing the extendible portion of the support and preventing movement of the extendible portion within the elongate portion of the support.

4. The system of claim 1, wherein the actuator is configured to slide along an axis that forms an angle with a longitudinal axis of the extendible portion, wherein the angle is from about 14 degrees to about 34 degrees.

5. The system of claim 1, wherein the actuator includes a retention system configured to engage and lockingly secure the extendible portion.

6. The system of claim 5, wherein the extendible portion includes a reception system operable to engage the actuator.

7. The system of claim 6, wherein the reception system includes longitudinally spaced openings, recesses, protrusions, and combinations thereof on an exterior surface of the extendible portion.

8. The system of claim 6, wherein the reception system is configured to cooperate with and engage the retention system of the actuator, thereby locking the extendible portion of the support in locked position.

9. The system of claim 8, wherein activating the actuator disengages the retention system from the reception system.

10. The system of claim 1, wherein the base member includes a first end and a second end, said first end of the base member includes a ball joint operable to pivot the base member relative to a longitudinal axis of the extendible portion.

11. The system of claim 1, wherein the first module assembly and the second module assembly are connected by an adaptor connector system.

12. A support for a platform system, the support comprising:

an elongate portion including a first end having a tapered portion and a second end;

an extendible portion operable to extend from and lockingly engage the second end of the elongate portion;

a base member removably attached to the extendible portion; and an actuator assembly having a housing affixed to the elongate portion and an actuator having an actuation force receiving surface and a biasing device positioned within the housing and in communication within the actuator, wherein in response to application of a force applied to the force receiving surface in a direction toward the biasing device, the actuator disengages the extendible portion, allowing gravity to extend the extendible portion downward to engage an underlying surface thereby; and wherein the support engages and removably secures to one or more receiving members of a first module assembly, the first module assembly being connected to a second module assembly;

wherein the actuator assembly is configured to rapidly extend and lockingly engage the extendible portion and the base member to provide self-leveling of the first module assembly and second module assembly of the platform system as the base member engages the underlying surface, wherein the first module assembly and the second module assembly are configured to remain continuously connected during the extending and the engaging of the actuator assembly.

13. The support of claim 12, wherein system the first module assembly and the second module assembly are connected by an adaptor connector system.

14. A method of assembling a platform system comprising:

providing a first module assembly and a second module assembly, each of the first module assembly and the second module assembly including one or more receiving members;

providing one or more supports, the supports comprising:

an elongate portion including a first end and a second end;

an extendible portion operable to extend from and lockingly engage the second end of the elongate portion;

a base member removably attached to the extendible portion; and an actuator assembly having a housing affixed to the elongate portion and an actuator having an actuation force receiving surface and a biasing device positioned within the housing and in communication within the actuator, wherein in response to application of a force applied to the force receiving surface in a direction toward the biasing device, the actuator disengages the extendible portion, allowing gravity to extend the extendible portion downward to engage an underlying surface thereby; and securing the one or more supports to the one or more receiving members;

actuating the actuator assembly, wherein the actuating extends the extendible portion until the base member engages the underlying surface, the base member providing self-leveling of each of the first module assembly and the second module assembly secured to the one or more supports; and locking the extendible portion to secure the one or more supports in an extended and level position, wherein the first module assembly and the second module assembly remain continuously connected during the self-leveling.

15. The method of claim 14, wherein the actuator assembly includes an actuator and a biasing device in communication with the actuator, the biasing device configured to bias the actuator into a locked position, thereby lockingly securing the extendible portion of the support and preventing movement of the extendible portion within the elongate portion of the support.

16. The method of claim 15, wherein the actuator includes a retention system configured to engage and lockingly secure the extendible portion.

17. The method of claim 16, wherein the extendible portion includes a reception system operable to engage the actuator.

18. The method of claim 16, wherein the reception system is configured to cooperate and engage the retention system of the actuator, thereby locking the extendible portion of the support in locked position.

19. The method of claim 18, wherein activating the actuator disengages the retention system from the reception system.

20. The method of claim 14, further including retracting the extendible portion back into the elongate portion, lockingly engaging the elongate portion into a storage position.

21. The method of claim 14, wherein the first module assembly and the second module assembly are connected by an adaptor connector system.

* * * * *